US006519997B2

(12) United States Patent
Luhm et al.

(10) Patent No.: US 6,519,997 B2
(45) Date of Patent: Feb. 18, 2003

(54) RIVET GUN

(75) Inventors: Ralph Luhm, La Habra Heights, CA (US); Magin Puig, Hacienda Heights, CA (US)

(73) Assignee: Allfast Fastening Systems, Inc., City of Industry, CA (US)

( * ) Notice: Subject to any disclaimer, the term of this patent is extended or adjusted under 35 U.S.C. 154(b) by 99 days.

(21) Appl. No.: 09/815,601

(22) Filed: Mar. 23, 2001

(65) Prior Publication Data

US 2002/0083569 A1 Jul. 4, 2002

Related U.S. Application Data

(63) Continuation-in-part of application No. 09/753,836, filed on Jan. 3, 2001.

(60) Provisional application No. 60/275,337, filed on Mar. 12, 2001.

(51) Int. Cl.[7] ..... B21D 31/00; B21J 15/00; B23P 21/00

(52) U.S. Cl. ..... 72/391.6; 29/243.523; 29/243.525; 29/243.53; 29/812.5; 227/57; 227/112; 206/347

(58) Field of Search ..... 29/812.5, 243.5, 29/524.1, 243.521, 243.525; 72/391.6, 453.19; 227/57, 59, 112; 206/347

(56) References Cited

U.S. PATENT DOCUMENTS

| | | | | |
|---|---|---|---|---|
| 2,592,636 A | | 4/1952 | Aherne-Heron | |
| 3,733,882 A | | 5/1973 | Klein | |
| 3,886,783 A | | 6/1975 | Hirsch | |
| 3,898,833 A | | 8/1975 | Richardson | |
| 4,027,520 A | | 6/1977 | Klein | |
| 4,310,056 A | | 1/1982 | Olsson | |
| 4,454,746 A | | 6/1984 | Schwab | |
| 4,515,005 A | | 5/1985 | Klein | |
| 4,604,889 A | | 8/1986 | Sukharevsky | |
| 4,609,134 A | | 9/1986 | Davern | |
| 4,628,722 A | | 12/1986 | Mauer et al. | |
| 4,630,460 A | | 12/1986 | Mauer | |
| 4,643,344 A | | 2/1987 | Kaita et al. | |
| 4,704,888 A | | 11/1987 | Frearson | |
| 4,744,238 A | | 5/1988 | Halbert | |
| 4,747,294 A | | 5/1988 | Schwartz et al. | |
| 4,765,175 A | * | 8/1988 | Denham et al. | 72/391 |
| 4,910,992 A | | 3/1990 | Stenberg et al. | |
| 5,042,131 A | | 8/1991 | Löw | |
| 5,090,807 A | * | 2/1992 | Ohuchi et al. | 227/57 |
| 5,136,873 A | | 8/1992 | Hopkins et al. | |
| 5,170,923 A | | 12/1992 | Dear et al. | |
| 5,184,497 A | | 2/1993 | Hanlon et al. | |
| 5,205,456 A | | 4/1993 | Ohuchi et al. | |
| 5,207,085 A | | 5/1993 | Hopkins et al. | |

(List continued on next page.)

FOREIGN PATENT DOCUMENTS

| | | |
|---|---|---|
| DE | 4324163 | 6/1994 |
| GB | 2273902 | 7/1994 |
| GB | 2273903 | 7/1994 |
| JP | 6-198379 | 7/1994 |

*Primary Examiner*—David Jones
(74) *Attorney, Agent, or Firm*—Blakely, Sokoloff, Taylor & Zafman LLP

(57) ABSTRACT

Automatic feeding blind rivet guns and method facilitating rapid installation of blind rivets with good freedom of movement of the operator. The blind rivet guns receive a carrier holding a substantial plurality of blind rivets in close side by side proximity and automatically sequentially loads and sets the blind rivets in response to operator control. The blind rivets are preferably supplied on an inexpensive disposable plastic carrier ready for use with the rivet installation gun. The installation gun itself is pneumatically powered, though other sources of power, such as electrical power, could be used.

51 Claims, 28 Drawing Sheets

U.S. PATENT DOCUMENTS

| | | | | |
|---|---|---|---|---|
| 5,236,341 | A | | 8/1993 | Stafford |
| 5,327,639 | A | * | 7/1994 | Wing et al. ..... 29/812.5 |
| 5,337,463 | A | | 8/1994 | Rössler et al. |
| 5,383,262 | A | | 1/1995 | Brown |
| 5,452,796 | A | | 9/1995 | Ohuchi |
| 5,469,610 | A | | 11/1995 | Courian et al. |
| 5,490,311 | A | | 2/1996 | Rosier |
| 5,490,312 | A | | 2/1996 | Smith |
| D369,733 | S | | 5/1996 | Rosier |
| 5,519,927 | A | | 5/1996 | Roessler |
| 5,544,407 | A | | 8/1996 | Ohuchi et al. |
| 5,600,878 | A | | 2/1997 | Byrne et al. |
| 5,651,169 | A | | 7/1997 | Ohuchi et al. |
| 5,653,368 | A | | 8/1997 | Miles et al. |
| 5,661,887 | A | | 9/1997 | Byrne et al. |
| 5,697,137 | A | | 12/1997 | Frearson et al. |
| 6,029,814 | A | | 2/2000 | Ohuchi |
| 6,098,442 | A | | 8/2000 | Walldorf et al. |
| 6,125,680 | A | | 10/2000 | Bradbury et al. |
| 6,182,345 | B1 | | 2/2001 | Travis |

* cited by examiner 40
37
38
39
3d
3d
41
42
43

RIVET GUN

This application is a continuation-in-part of application Ser. No. 09/753,836, filed Jan. 3, 2001, entitled "Rivet Gun" and claims the benefit of U.S. Provisional Patent Application No. 60/275,337, filed Mar. 12, 2001.

BACKGROUND OF THE INVENTION

1. Field of the Invention

The present invention relates to blind rivet installation equipment.

2. Prior Art

Blind rivets are well known in the prior art, being settable from one side of the work pieces to be joined by the rivet without requiring bucking or other access to the opposite side of the work pieces. Blind rivets are characterized by a hollow-headed shank with a stem extending therethrough, the stem having some provision for expanding the shank as the stem is pulled from the head-end of the rivet. In some types of rivets, the stems are pulled all the way through the rivet, leaving a hollow installed rivet. In other cases, the stem will first form an expanded tail on the shank as if it had been bucked, then intentionally break, usually with some form of locking provision so that the portion of the stem remaining in the installed rivet becomes a permanent and secure part of the installed rivet.

Installation tools for blind rivets of various types are also well known. Such tools include hand powered devices, compressed air powered devices and electrically powered devices, including devices powered by rechargeable batteries. In the prior art, these devices are single shot devices, requiring the manual loading of each rivet prior to the installation of the rivet. While an experienced riveter can fairly quickly load each rivet into the gun, the manual loading requirement still reduces the rate at which the blind rivets may be installed.

Finally, installation systems are known which automatically feed the rivets to the gun for higher speed installation. Such a system used for a proprietary tacking rivet manufactured by Allfast Fastening Systems, Inc., the assignee of the present invention, is the Allfast TackMatic™, sold by the assignee of the present invention. That system utilizes a console unit that automatically feeds the rivets to a handgun, sets the rivets, and then collects the spent stems. The handgun is tethered to the console unit by a line through which the rivets are fed and by a high pressure air hose for powering the handgun. The console unit may be made relatively mobile by placement on a wheeled cart, though limitations on the length of the flexible rivet feeding tube, etc. limit the range of motion of the installation gun. Consequently, while such systems work well on assembly lines for individual assembly of products that are not particularly large, they are generally not used in aircraft manufacture because of the mobility required because of the size of the assembly on which the rivet installation system would have to be used.

BRIEF SUMMARY OF THE INVENTION

Automatic feeding blind rivet guns and method facilitating rapid installation of blind rivets with good freedom of movement of the operator. The blind rivet guns receive a carrier holding a substantial plurality of blind rivets in close side by side proximity and automatically sequentially loads and sets the blind rivets in response to operator control. The blind rivets are preferably supplied on an inexpensive disposable plastic carrier ready for use with the rivet installation gun. The installation gun itself is pneumatically powered, though other sources of power, such as electrical power, could be used.

DETAILED DESCRIPTION OF THE PREFERRED EMBODIMENT

The present invention comprises a rivet gun operable with a cartridge holding multiple blind rivets, and controllably operable by an installer to install individual rivets and automatically load successive rivets for installation. For purposes of explanation and not by way of limitation, a specific embodiment is disclosed in detail herein to illustrate one implementation of the broad concepts of the present invention. Further, for purposes of explanation only, the specific rivet illustrated is the Allfast FASTACK™ tacking rivet manufactured by Allfast Fastening Systems, Inc., assignee of the present invention, under Allfast's U.S. Pat. No. 5,689,873 "Tacking Fastener" patent.

Figure 1:
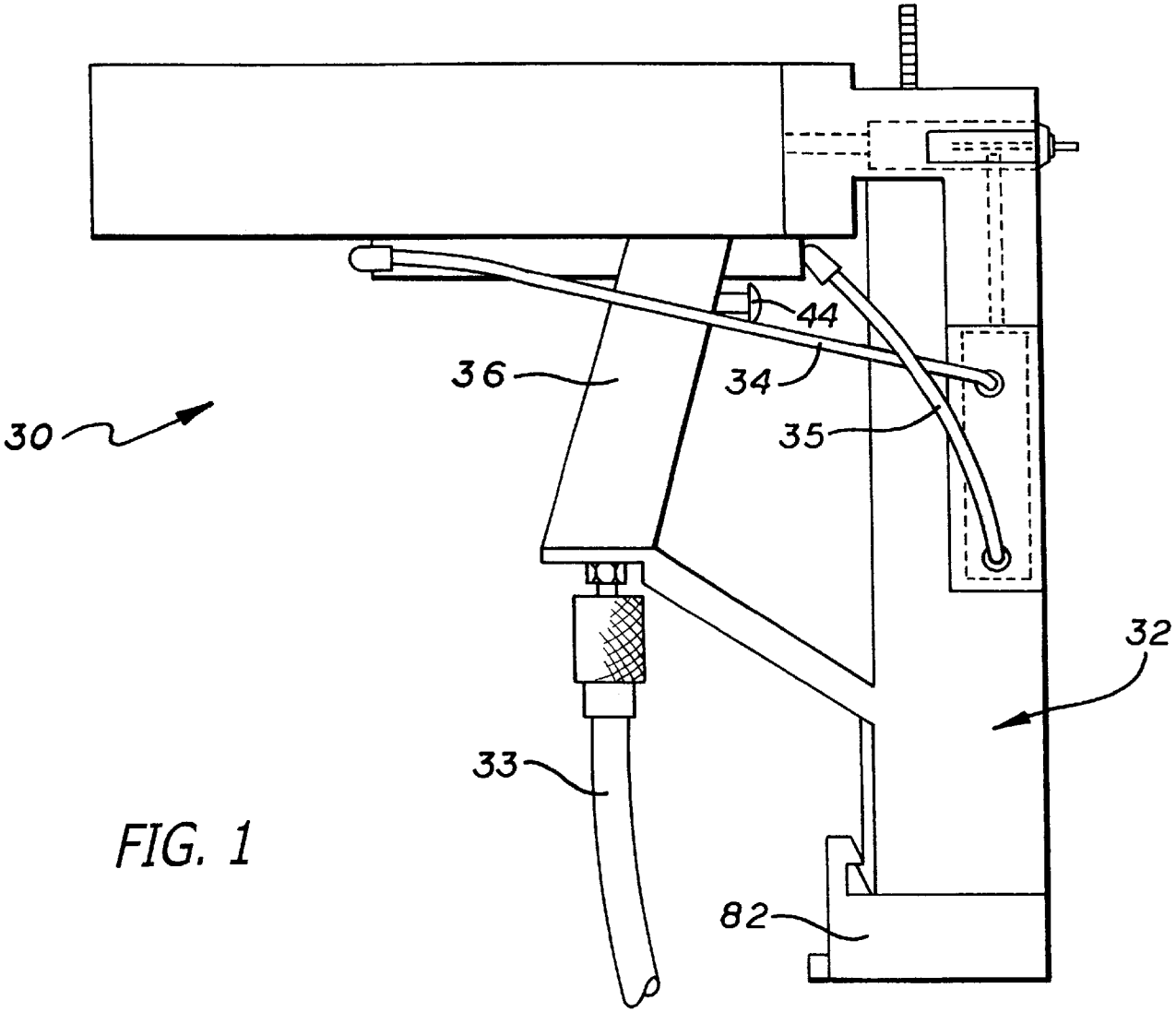
FIG. 1 is a side view of an exemplary embodiment of a blind rivet gun in accordance with the present invention.
Figure 2:
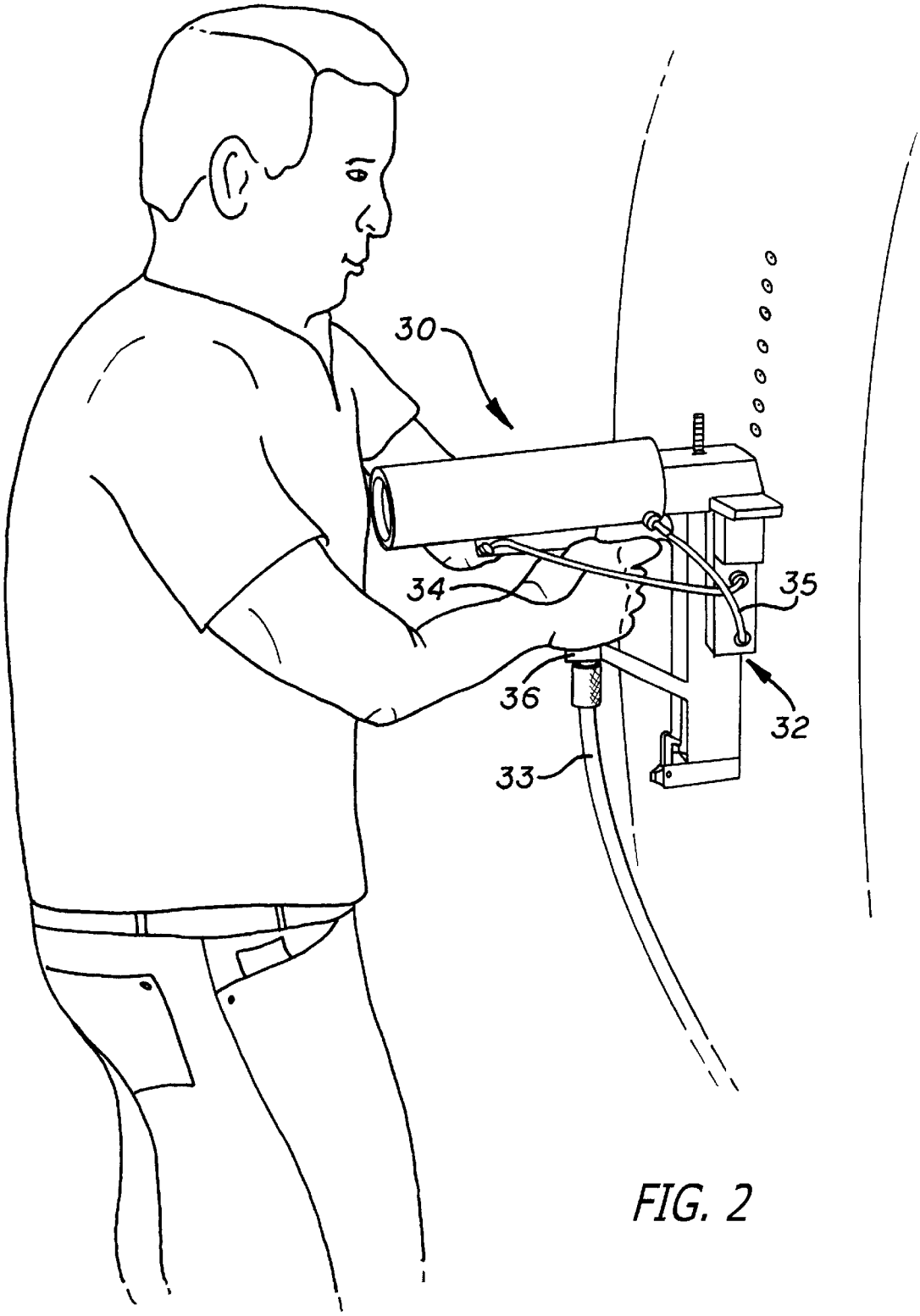
FIG. 2 is an illustration of an operator using the blind rivet gun of FIG. 1.
Figures 3A, 3B, 3C, 3D:
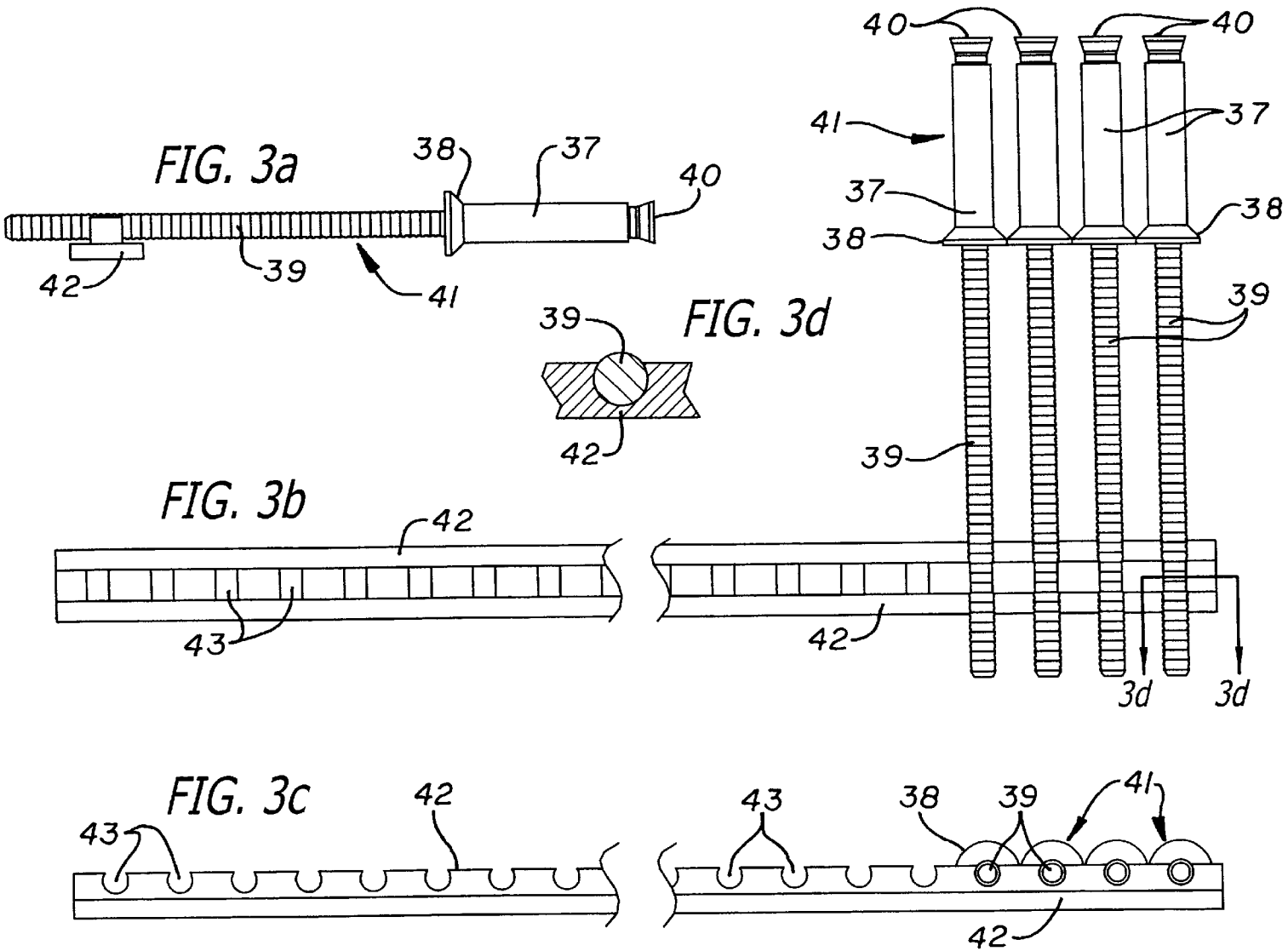
FIGS. 3*a* through 3*d* illustrate the blind rivet and the rivet carrier used with the preferred embodiment of the present invention.

First referring to FIGS. 1 and 2, an illustration of an exemplary embodiment of the present invention rivet gun and a rivet installer using the rivet gun may be seen. The rivet gun itself is characterized by what will be referred to herein as a barrel assembly 30, and a magazine assembly 32 for automatically feeding rivets into the installation position. The rivet gun in the exemplary embodiment is powered by pressurized air provided through air hose 33, with the operation of the barrel assembly 30 and the magazine 32 being coordinated through air lines 34 and 35. The rivet gun also includes a handle assembly 36 with trigger 44.

In the exemplary embodiment, the rivets illustrated and for which the exemplary rivet gun is adapted are illustrated in FIGS. 3*a*–3*d*. The rivets are characterized by a shank 37 with integral head 38, in this embodiment a conical head, with a stem 39 extending through the head and shank and having a tail-former 40 adjacent the end of the shank 37. In use, the tail-former 40 and shank 37 are inserted through a mating hole in the workpieces to be joined so that the head 38 abuts the surface of the outer workpiece, then the stem 39 is pulled with respect to head 38. The tail-former 40 forms a bulbous end on the shank 37, pulling the workpieces together, until the tail-former 40 deflects inward and is pulled entirely through the shank and head 38. This leaves the installed shank and head as a hollow tack rivet for later drilling out for installation of a permanent rivet. The tack rivet shown, however, is used as exemplary only, as the present invention may readily be used with blind rivets of other designs, including but obviously not limited to, blind rivets wherein after the workpieces have been pulled together and the stem end expanded in some form, a portion of the stem is locked to the head or shank of the rivet, after which the stem fractures adjacent the head end of the installed rivet and is disposed of.

In the exemplary embodiment, the rivets generally indicated by the numeral 41 are held in parallel close side by side disposition by a plastic U-shaped 42 having pockets 43 therein retaining the stems 39 of the rivets. The rivets on the carrier preferably are spaced as close together as reasonably possible to maximize the number of rivets on the carrier, and as will subsequently be appreciated, are spaced closer than would allow the passage of a pulling head (with or without a housing around the pulling head) concentric with one rivet to engage that rivet without disturbing or dislodging at least one other rivet on the carrier. In some cases the rivets may be touching each other. In other cases, the rivets may be spaced slightly apart, though usually not by as much as to allow the inclusion of another rivet on the carrier if the rivets had been placed closer together. In any event, the rivets will be spaced closer together than will allow the passage of the pulling head with or without housing as described above. The plastic carrier 42 is preferably injection molded using a somewhat rigid though malleable plastic so that the rivet stems are firmly held, but may be forced out of the pockets in the plastic carrier without chipping or breaking the carrier.

Figure 4:
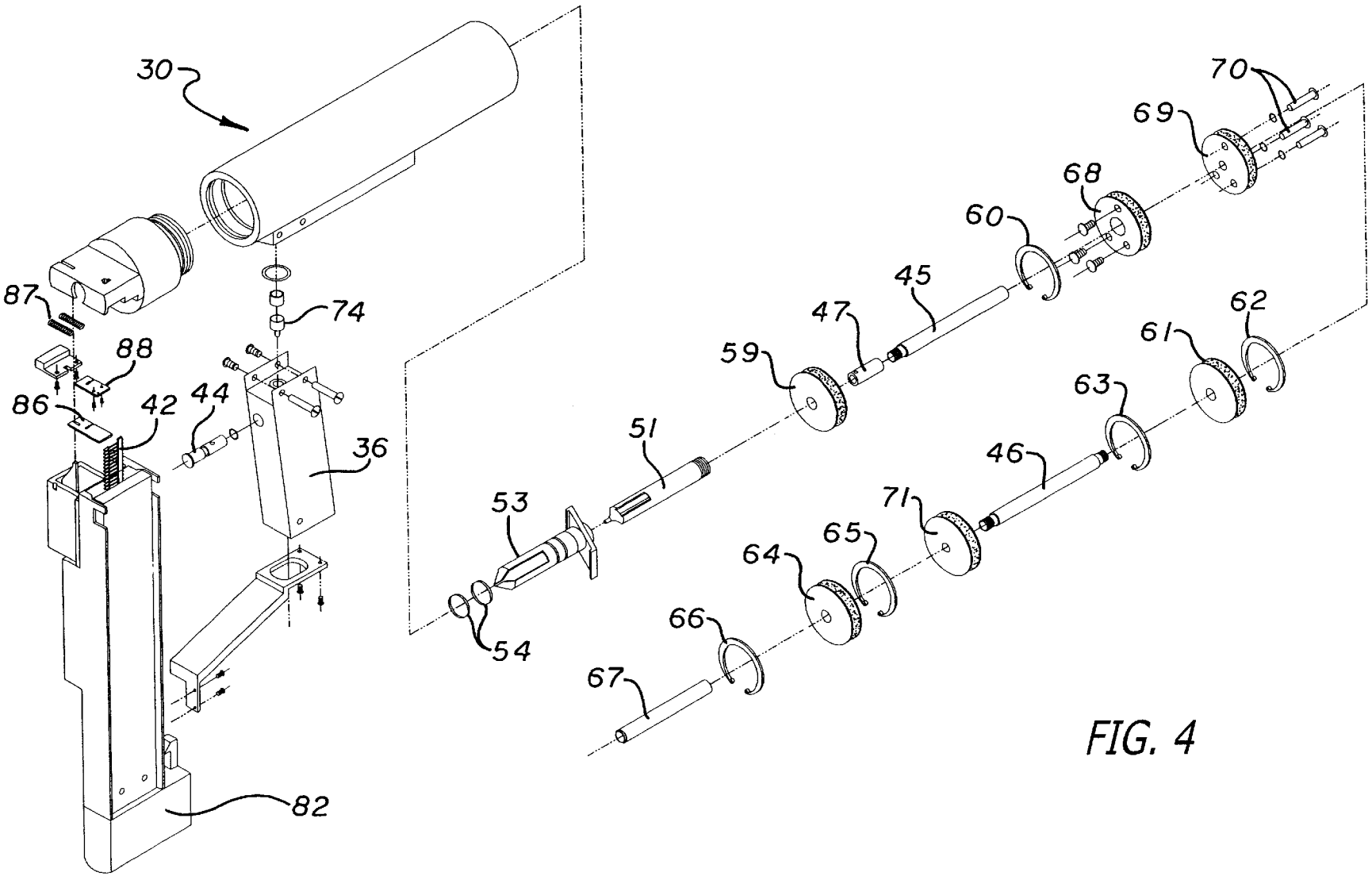
FIG. 4 is an exploded view of the pulling head actuator of the present invention.

FIG. 4 is an exploded view of the exemplary rivet gun of the present invention, particularly showing the barrel assembly 30 in exploded form. In general, this Figure will not be described specifically, but the corresponding parts labeled in other Figures will similarly be labeled in FIG. 4 for further reference.

Figure 5:
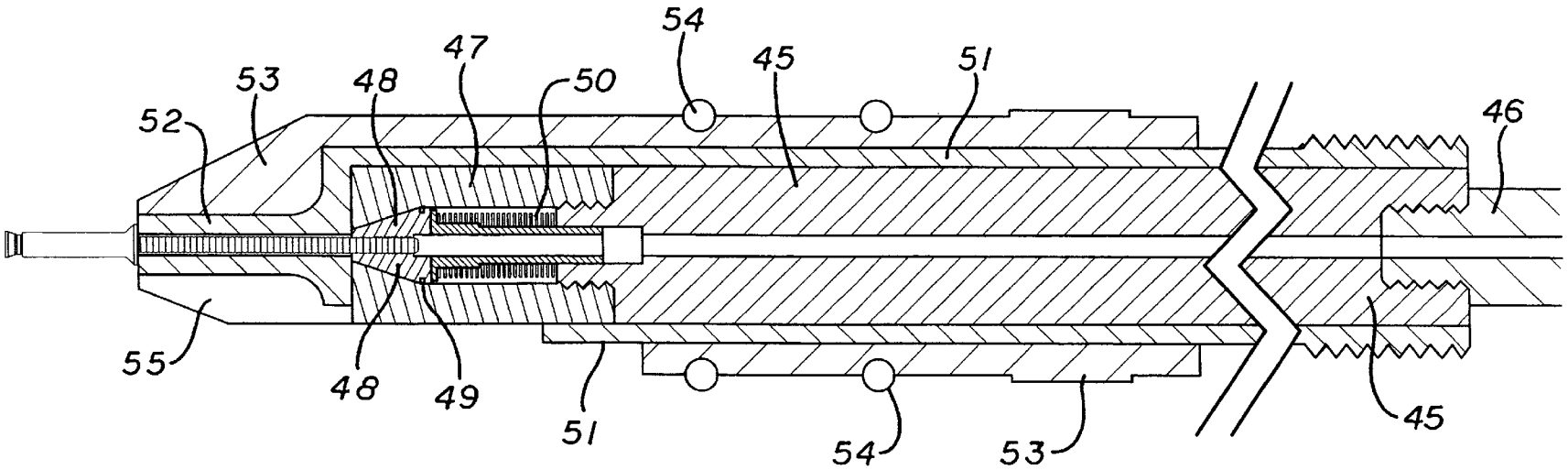
FIG. 5 is across sectional view of the pulling head used with the preferred embodiment of the present invention.

Now referring to FIG. 5, a cross-section of the pulling head used with the present invention may be seen. The pulling head includes a draw bolt 45, coupled at one end to a draw bolt extension 46 and at the other end to a collet 47 holding jaws 48 therein. Jaws 48, typically three in number each spanning on the order of 120°, are serrated on their inner diameters to grip the complimentary serrations on the stem 39 of the rivet, being encouraged to a closed position by an O-ring 49 in a groove in the jaws. The jaws are also encouraged toward a left-most closed position by a spring 50 acting between the end of the draw bolt 45 and the larger end of the jaws. With this construction, and the cooperative shape of the serrations on the rivet stem and the jaws, a rivet stem may be relatively easily pushed into (and even through) the jaws from the left side as viewed in FIG. 5, though may not be pulled back out of the jaws from that direction.

The collet 47 and draw bolt 45 have a sliding fit within housing 51 which has an extension 52 engaging the rivet head during the pulling to hold the rivet in the hole in the workpieces as the stem of the rivet is pulled to form the end of the shank and to then pass through the rivet shank and rivet head. Housing 51 and its integral extension 52 are positioned within holding members 53, which may also be seen in FIG. 6. These two members, separated along a vertical plane, are elastically encouraged toward each other by O-rings 54, visible in both FIGS. 5 and 6. As may be seen perhaps best in FIG. 6, the forward part of members 53 are relieved in region 55 so as to provide a tapered vertical entry for a rivet into the position shown in FIG. 6, with members 53 initially holding the shank of the rivet as shall subsequently be described in greater detail.

Figure 6:
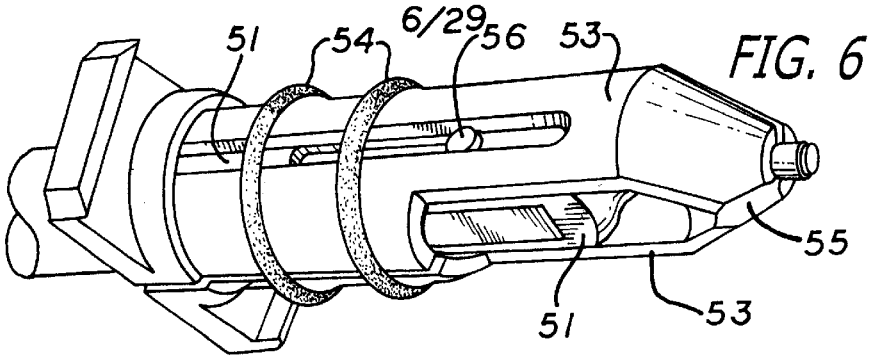
FIG. 6 is a perspective view of the pulling head and rivet.

Also visible in FIG. 6 is one of a pair of pins 56, one on each side of the collet 47, extending into cooperatively disposed slots in housing 51 and members 53. As shall subsequently be seen, these pins, together with the associated slots, define the limits of the relative motion between the collet 47, the housing 51 and the members 53.

Figure 7A:
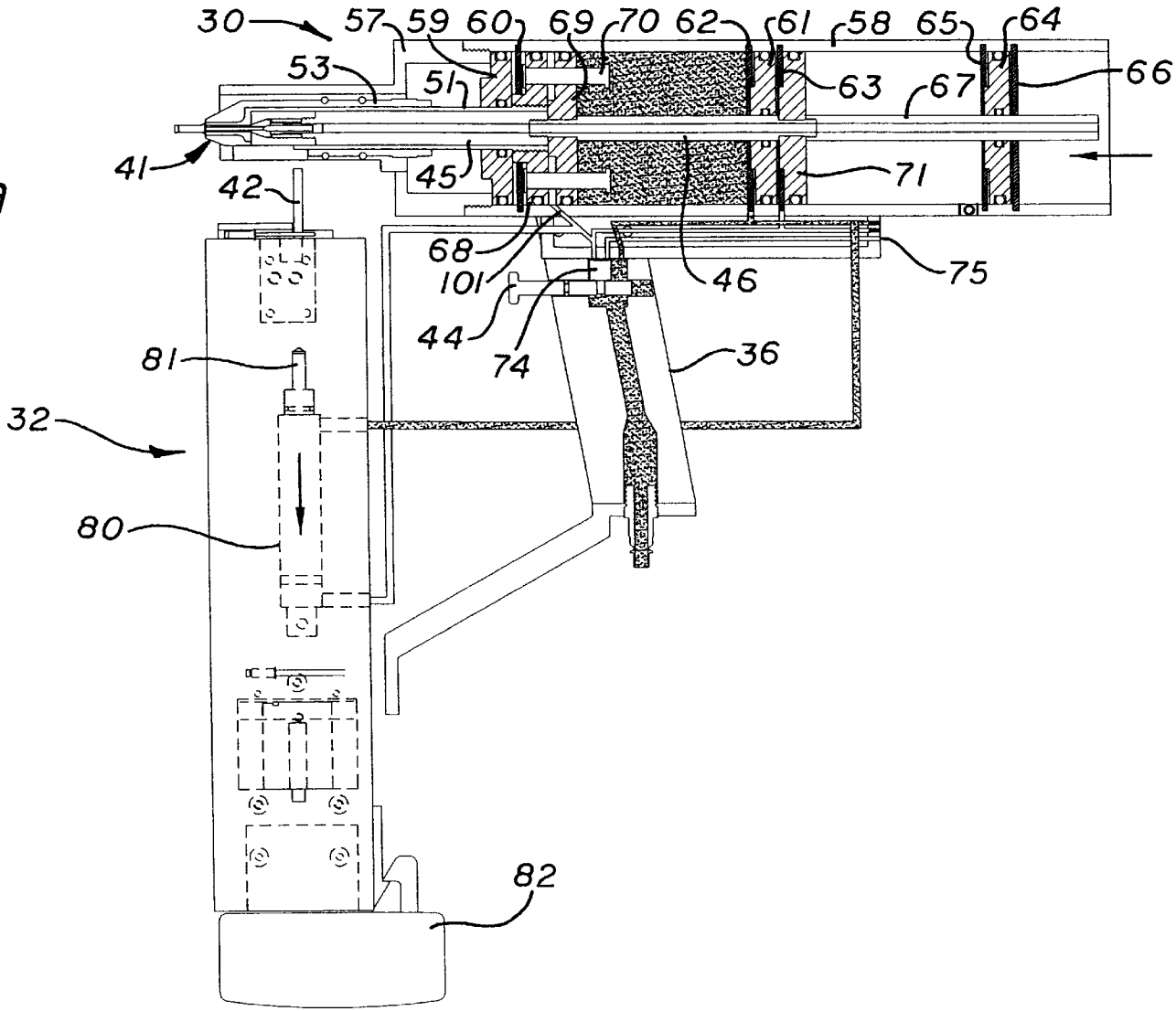
FIGS. 7*a* through 7*e* illustrate the relative positions of the mechanisms of the preferred embodiment rivet gun with a rivet in the pulling position.
Figure 7B:
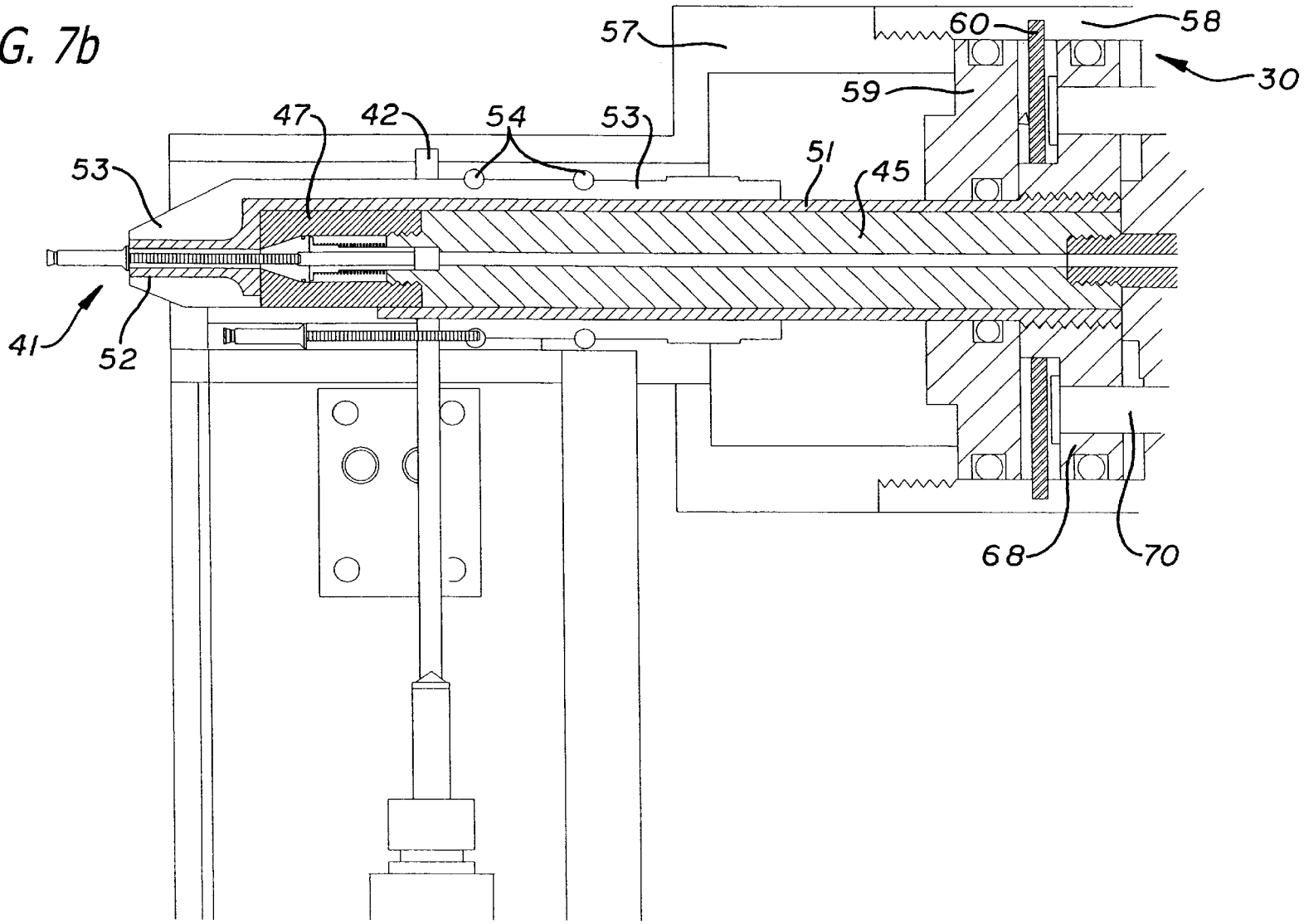
Figure 7C:
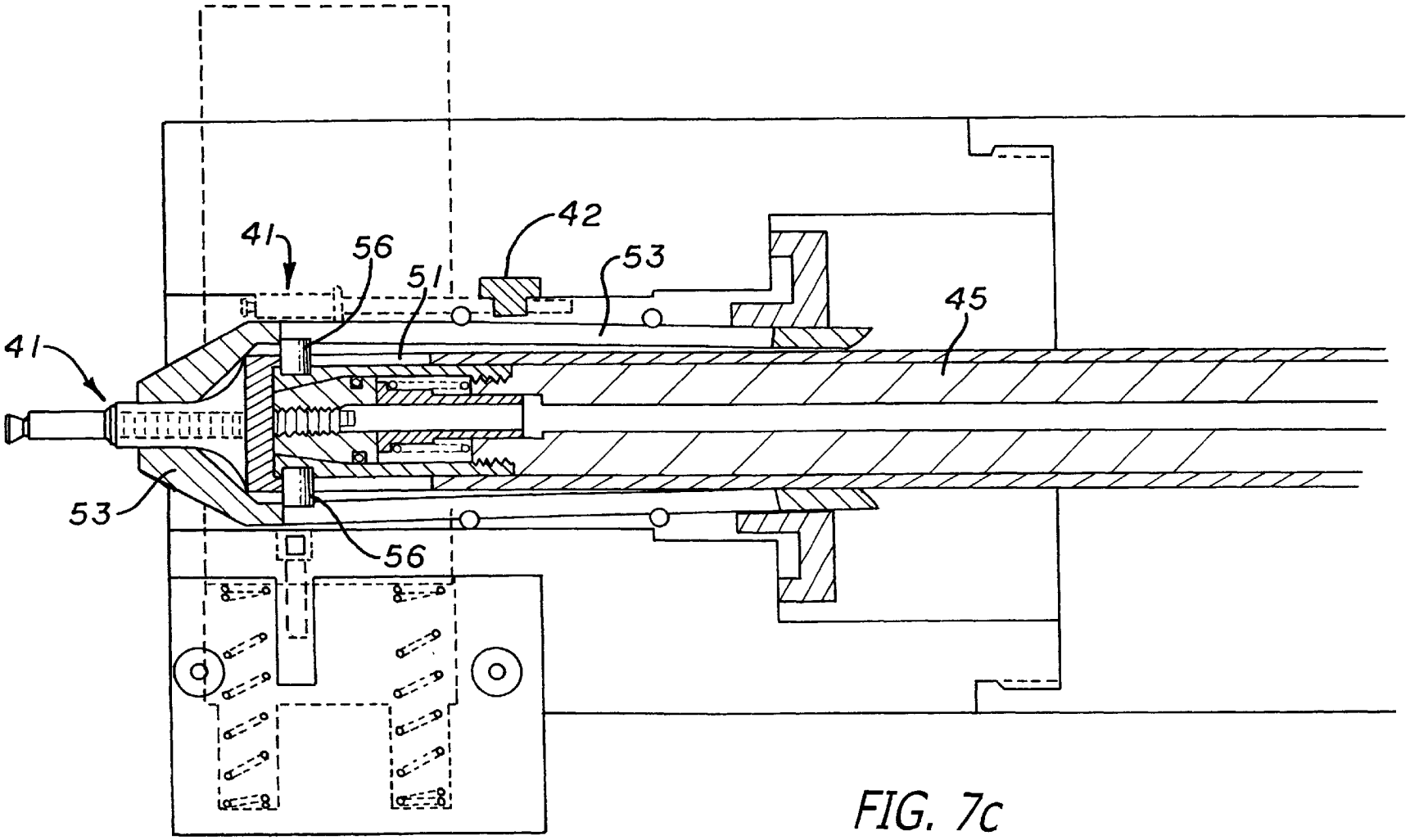

FIGS. 7*a*, 7*b* and 7*c* illustrate the relative position of the various parts in the pulling head, barrel assembly and magazine assembly when a rivet is in position ready for pulling. In FIG. 7*a*, the magazine assembly is shown detached and slightly dropped with respect to the barrel assembly for better clarity in the explanation to follow. As shown in FIG. 7*a*, a portion of which is shown in expanded scale in FIG. 7*b*, the barrel assembly 30 includes a forward barrel member 57 and a cylindrical barrel member 58 threaded thereto. Within the barrel assembly is housing 51 and draw bolt 45, as well as draw bolt extensions 46 and 67 (see also FIG. 5 for an expanded view of some of these parts). The barrel assembly 30 includes a first pressure barrier 59 trapped between forward housing member 57 and snap ring 60, a second pressure barrier 61 trapped between snap rings 62 and 63, and a third pressure barrier 64 trapped between snap rings 65 and 66, the snap rings being of conventional design, snapping into complementary grooves in the inside diameter of cylindrical housing member 58. These pressure barriers have an O-ring seal at their outer periphery and a sliding seal on their inner periphery to allow linear translation of the housing 51 and draw bolt extensions 46 and 67.

Also located within cylindrical housing member 58 are a number of pistons, one being fastened to housing 51 and the other two being fastened to drawbolt 45/drawbolt extensions 46 and/or 67. In particular, piston 68 is fastened to housing 51, and accordingly, moves in translation along the barrel assembly in unison therewith. Piston 69 is coupled to drawbolt 45/drawbolt extension 46 so as to move in unison therewith, piston 69 being limited in motion with respect to piston 68 by pins 70, with sliding seals between the piston 69 and pins 70 preventing significant leakage of air. In that regard, FIG. 7*a* suggests two pins 70, or at least an even number of pins, though in the preferred embodiment three pins spaced 120° apart are actually used as shown in FIG. 4. Also coupled to drawbolt extensions 46 and 67 is another piston 71.

The handle assembly 36 is connected to an airhose (not shown in FIG. 7*a*) with a trigger 44 determining the porting of the air under pressure, typically on the order of 90 psi, to the pneumatic actuator in the barrel assembly just described. The trigger 44 is coupled to member 74 that couples the center of three ports to either the left port or the right port, with the remaining of the three ports being coupled to the high pressure air. As shown in FIG. 7*a,* the left port is coupled to the center port, and the right port is coupled to the high pressure air. If, on the other hand, when the trigger 44 is depressed, member 74 will slide to the right, coupling high pressure air to the left port and coupling the center port to the right port. In this porting, the center port is a vent to atmosphere, being vented thereto through opening 75 in the manifolding.

With the trigger released as shown in FIG. 7*a,* the high pressure air is ported to the region between piston 69 and pressure barrier 61, forcing piston 69 forward against piston 68, holding both housing 51 and members 53 (see also FIG. 7*b*) in their forward-most position. In this position, rivet 41 is ready for insertion into the hole in the workpieces to be joined, and then pulled. FIG. 7*c* is a cross-section taken looking upward toward the axis of the rivet and draw bolt assembly. This Figure illustrates the relative position of the various parts as viewed from beneath the pulling head, and further illustrates the then existing relative position of pins 56 with respect to the slots in housing 51 and member 53.

Figure 8:
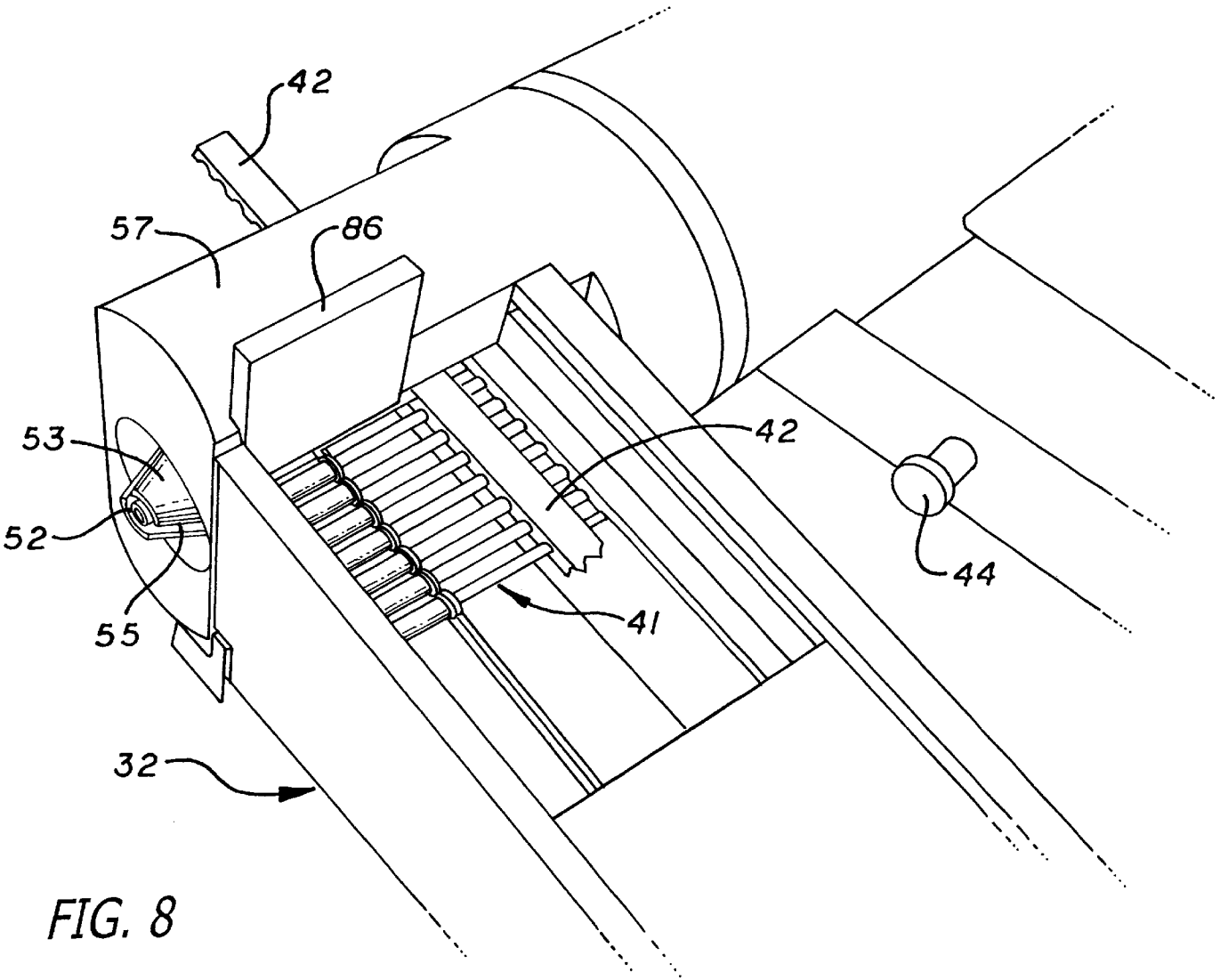
FIG. 8 is perspective view showing the rivets on a rivet carrier in the magazine of the preferred embodiment.

Referring again to FIG. 7*a,* in the rivet ready for setting condition of the rivet gun, the high pressure air is also ducted to the top of an actuator 80 in the magazine assembly, holding the actuator member 81 in its lower-most position. The magazine assembly itself receives carrier 42 with a plurality of rivets 41 thereon (see FIG. 8), with a spring acting against the rivet stem of the lowest rivet to encourage the rivets and carrier upward. The carrier of rivets is loaded into the magazine assembly from the bottom thereof, the removable bottom cover 82 providing access for the loading of the rivets. Details of the spring assembly, etc. are not shown, as the same are similar in certain respects to a handgun cartridge clip.

Figure 10:
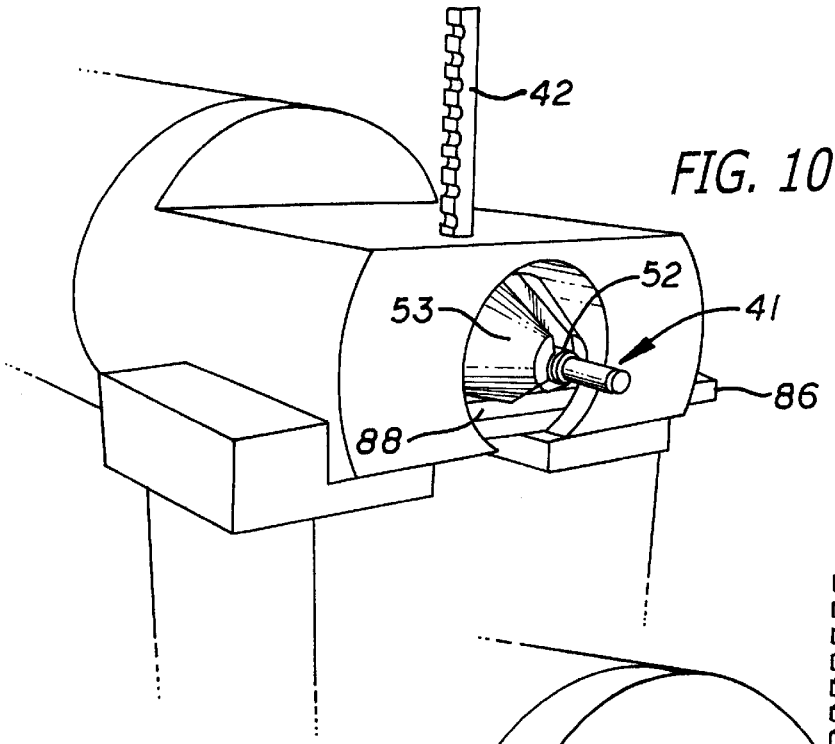
FIG. 10 is a perspective view of the pulling head with a rivet in the pulling position.
Figure 7D:
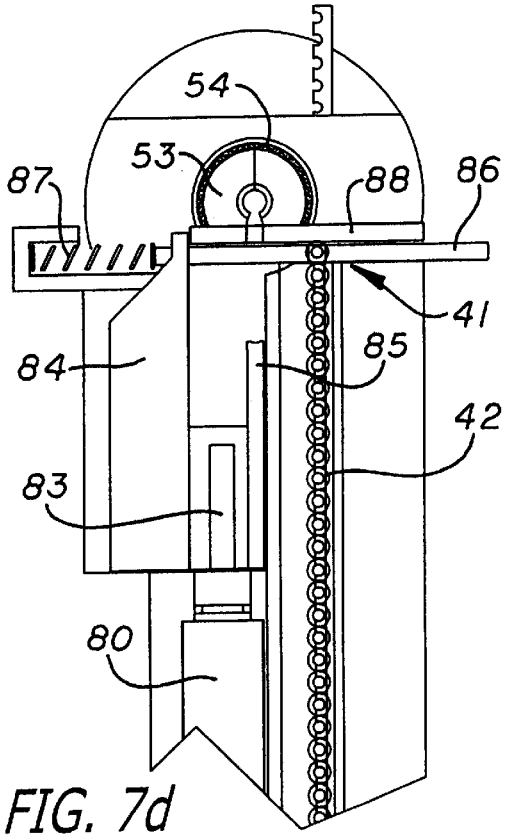
Figure 9:
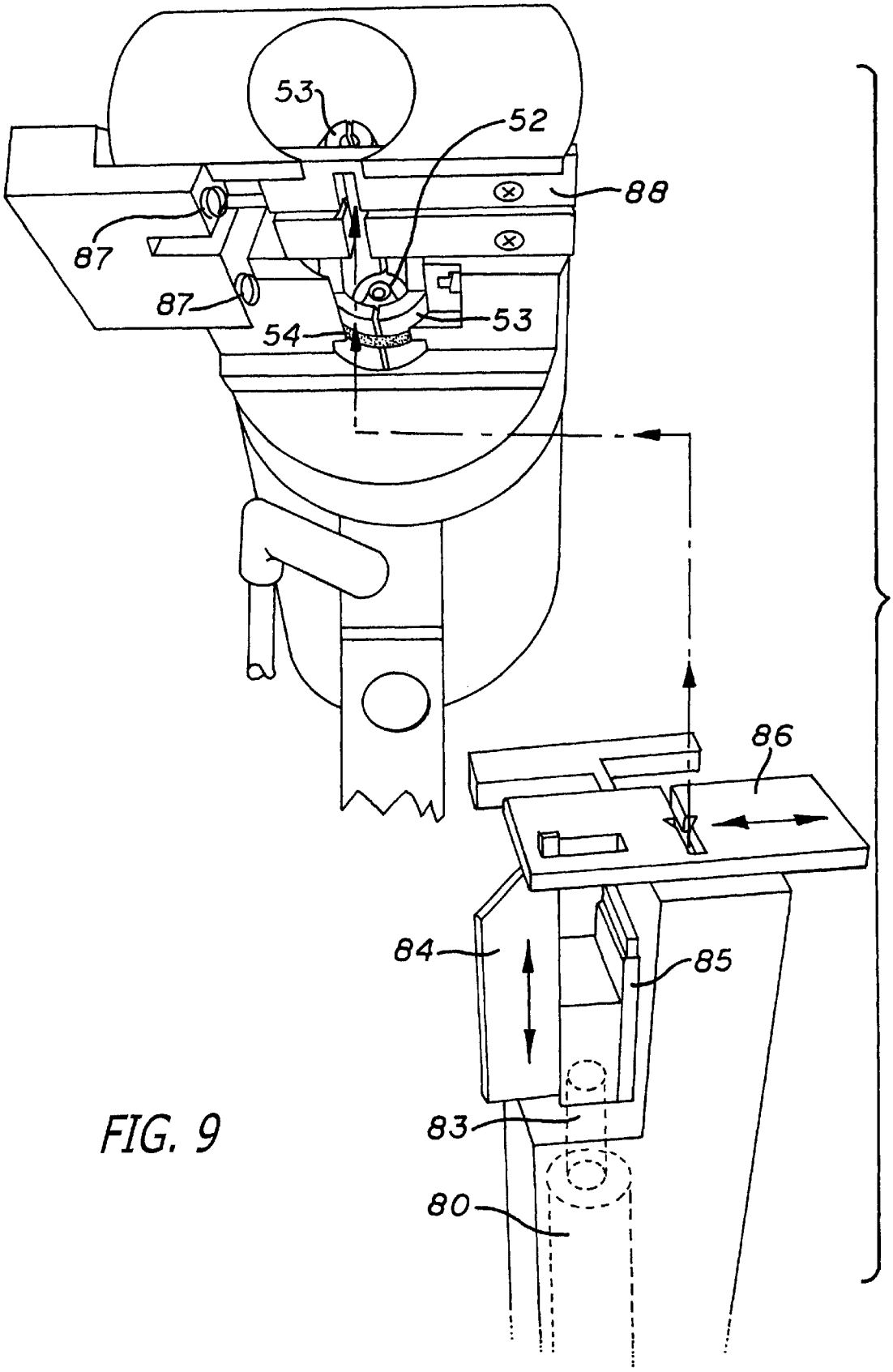
FIG. 9 is a perspective exploded view of a part of the rivet loading system of the preferred embodiment.
Figure 11:
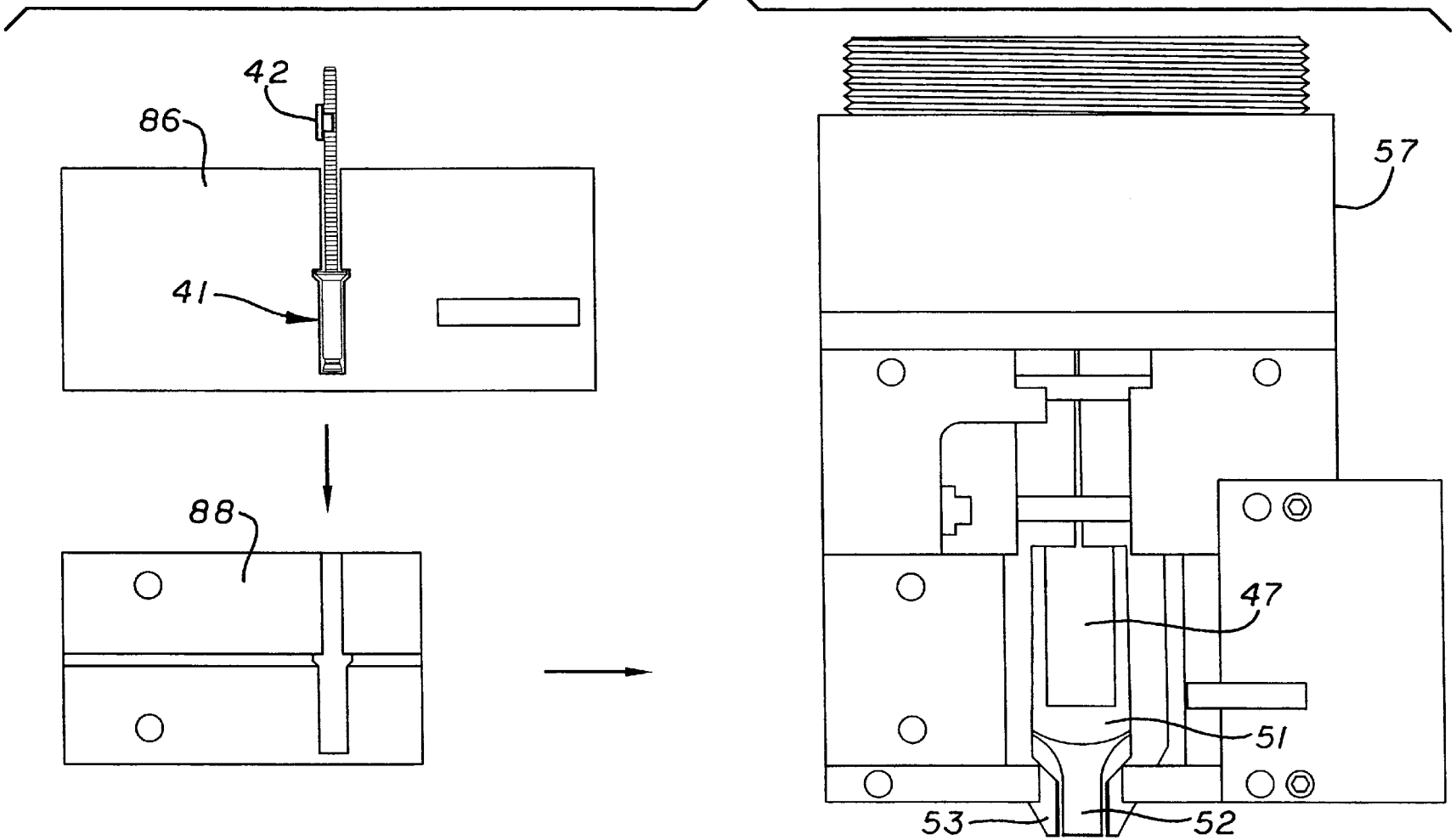
FIG. 11 is an exploded view of a part of the rivet loading system of the preferred embodiment.

The actuator 80 has mounted thereon a top assembly, shown in an end view in FIG. 7D and in perspective in FIG. 9, an exploded view for illustration purposes. As shown in these two Figures, the piston rod 83 has a cam plate 84 and a pusher plate 85 mounted thereon. Cam plate 84 controls slide plate 86, which as shown in FIGS. 7*d* and 9, is yieldably encouraged to its right-most position by springs 87. Immediately above slide plate 86 is a fixed plate 88 having an opening therein directly below the axis of the pulling head and members 53. As may be seen in FIG. 7*d,* with the slide plate 86 in the right-most position, the top-most rivet 41 has been encouraged upward by the magazine spring into the complementary opening (see FIG. 9) in the slide plate, the groove in fix plate 88 providing clearance for the rim of the rivet head. Slide plate 86 and the fixed plate 88 are also shown in plan form in FIG. 11, illustrating the complementary nature of the openings in the plates relative to the outline of the rivet with which the rivet gun will be used. The relative position of the rivet carrier 42 and slide plate 86 in this embodiment may be seen in FIG. 8, the carrier 42 passing at one side of the slide plate 86 as rivets are removed from the carrier and installed. The relative position of various parts are also illustrated in the perspective view of the head region of the gun of FIG. 10, showing the carrier 42, a rivet 41 in the pulling position and the relative position of members 53.

Figure 12A:
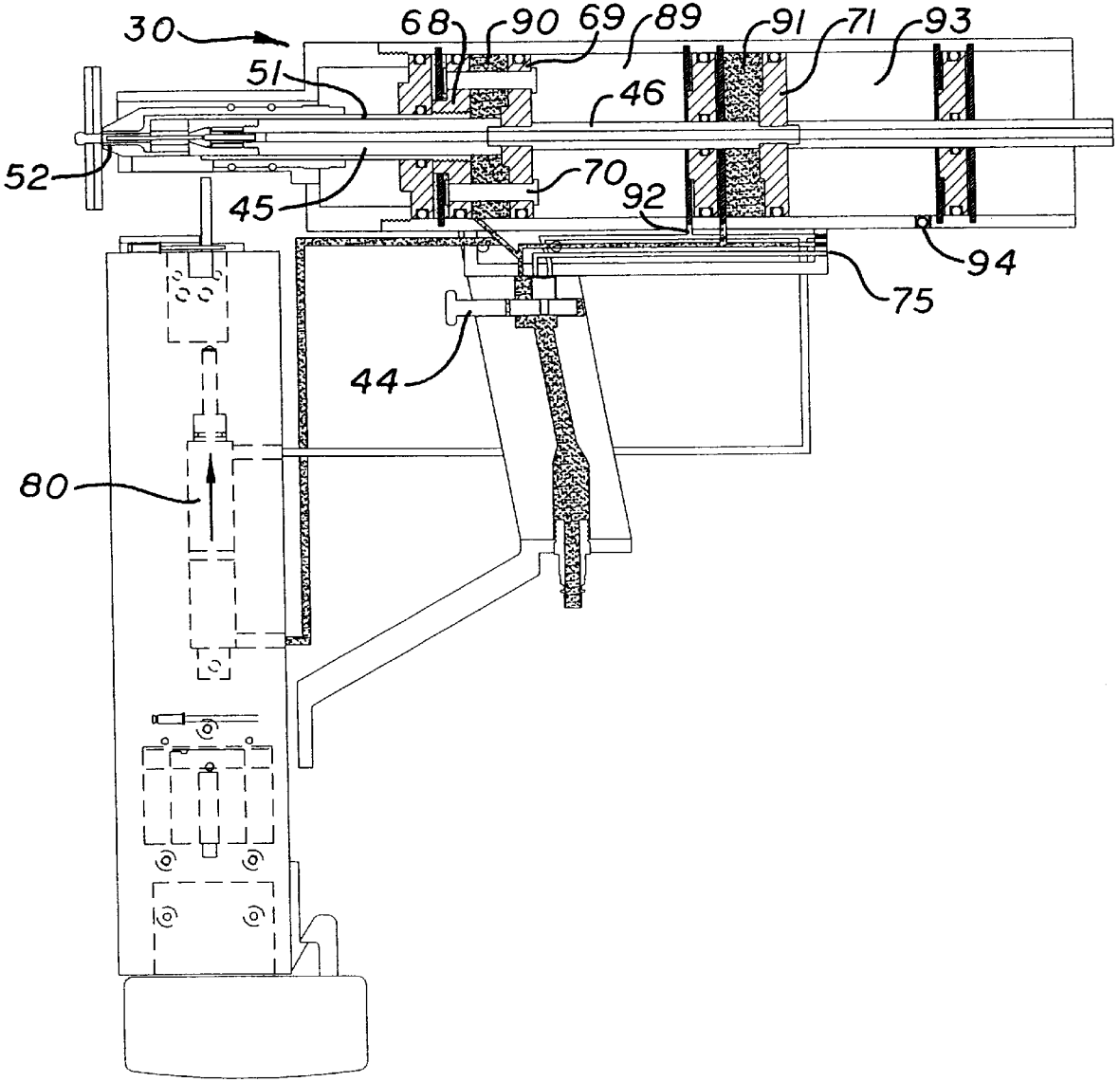
FIGS. 12*a* through 12*c* illustrate the relative positions of the mechanisms of the preferred embodiment rivet gun when a rivet has just been pulled.
Figure 12B:
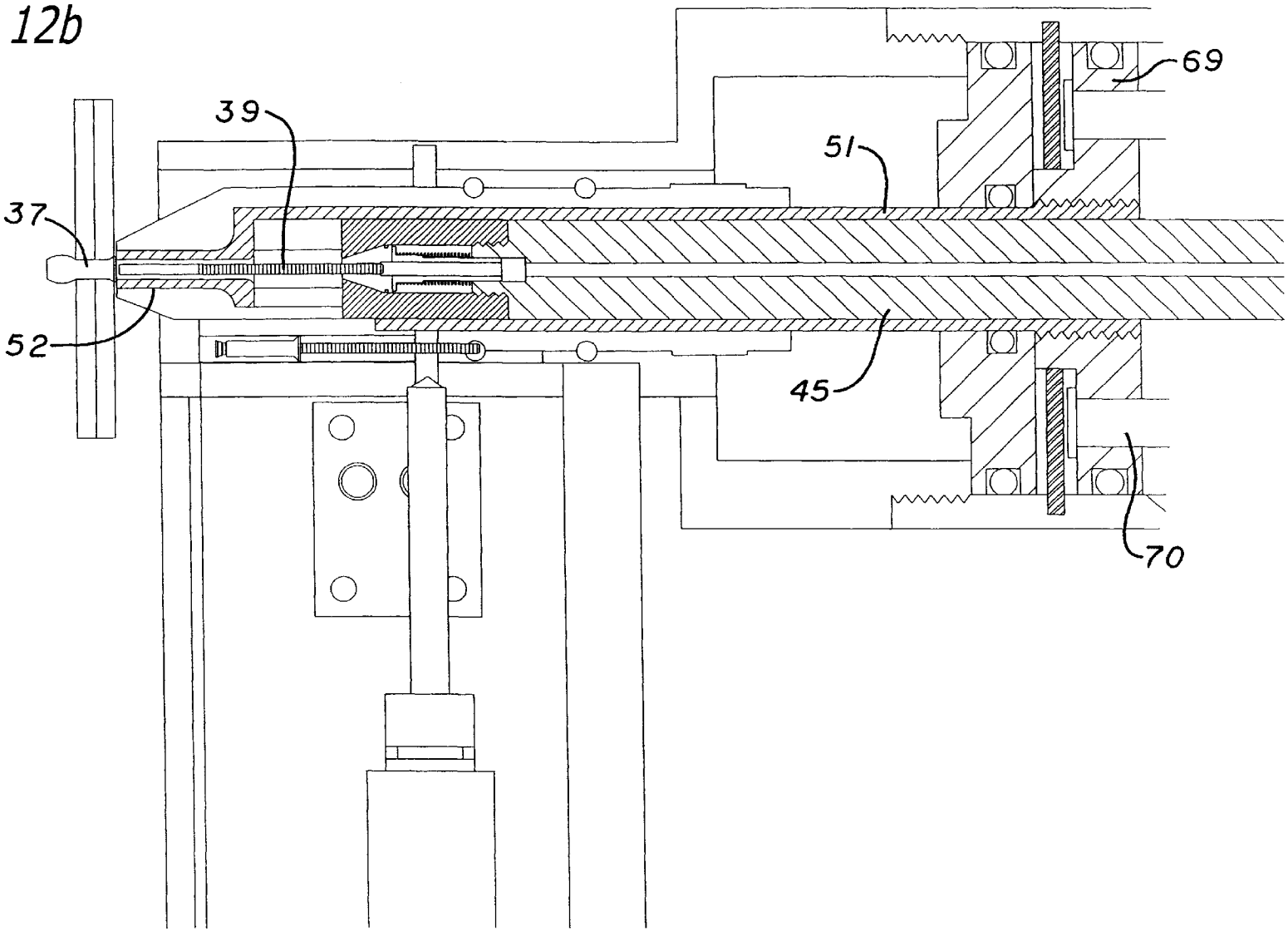
Figure 12C:
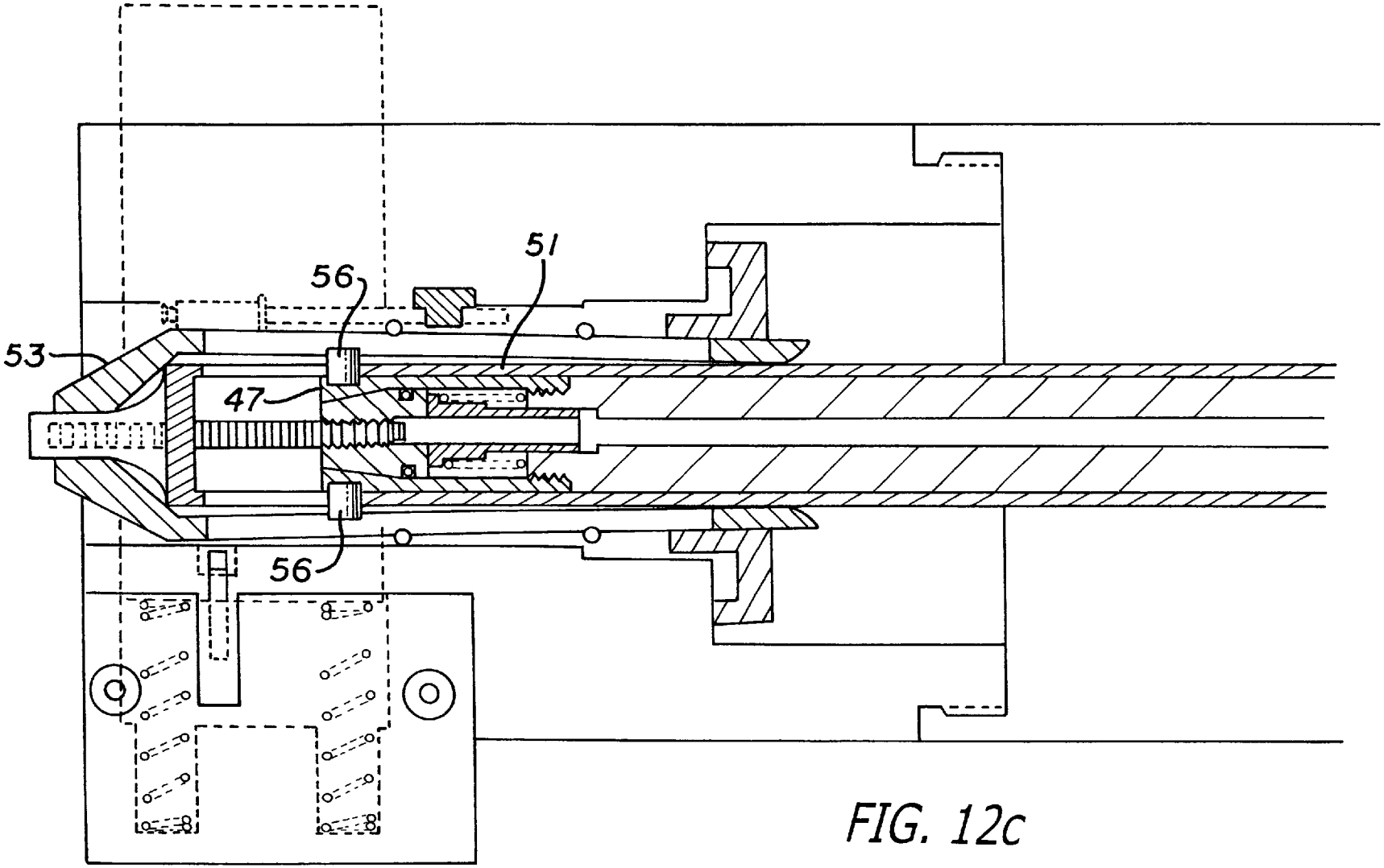

Now referring to FIGS. 12*a* through 12C, the initial motion of the various parts of the rivet gun upon pulling of the trigger control 44 may be seen. FIG. 12*a,* like FIG. 7*a,* is a partial cross-section of the entire gun illustrating the porting of the high pressure air and the position of the pistons in the barrel assembly 30 and the actuator 80 in the magazine. FIG. 12*b* is a portion of the assembly of FIG. 12*a* taken on an expanded scale, and FIG. 12*c* is a cross-section of much of the assembly of FIG. 12*b,* though presented as a view looking up at the pulling head, as opposed to the side view of FIG. 12*b*.

As shown in FIG. 12*a,* when the trigger control 44 is depressed, region 89 is vented to atmosphere and regions 90 and 91 are coupled to the high pressure air. The pressure in chamber 91 acts against piston 71, pulling the drawbolt extension 46 and thus the drawbolt 45 to pull the stem of the rivet to set the rivet. At the same time, the pressure in chamber 90 acts against piston 68 to hold the extension 52 on the housing 51 against the head of the rivet, so that the head of the rivet is not pulled away from the adjacent workpiece. While piston 69 is also connected to the drawbolt assembly, the primary pulling of the rivet stem is believed to be done by piston 71, the pressure in chamber 89, though decreasing during the pulling because of the venting of the chamber through vent port 92, minimizes at least the initial pulling force provided by piston 69. When the pulling is complete, piston 69 will move to the position shown in FIG. 12*a,* namely at its right-most limit of its travel with respect to piston 68 to engage the pins 70 on piston 68. As may be seen in FIG. 12*b,* the distal end of the shank 37 of the rivet has been formed and the rivet stem 39 has been pulled all of the way through the rivet shank and head. Of course, in alternate embodiments intended for use with blind rivets wherein during the pulling of the rivet the stem is locked in position after pulling and the remaining stem fractures adjacent the head, only the fractured part of the stem will then remain engaged by the pulling head.

Once pulling is complete, as illustrated in FIGS. 12*a* and 12*b,* the pressure in chamber 91 will continue to move piston 71, and thus the drawbolt assembly, further to the right. Referring to FIG. 12*c,* a cross-sectional view from below, it may be seen that pins 56 in collet 47 are at their right-hand most position with respect to the slots in housing 51. Accordingly, any further movement of piston 71 to the right, as shown in FIGS. 12*a* and 12*b,* will also pull housing 51 to the right. Thus, the entire piston assembly and pulling head will move to the right-hand extreme of their travel, as illustrated in FIGS. 13*a* and 13*b,* the air in chamber 93 (FIG. 12*a*) being vented to atmosphere during this motion by vent 94.

Figure 13H:
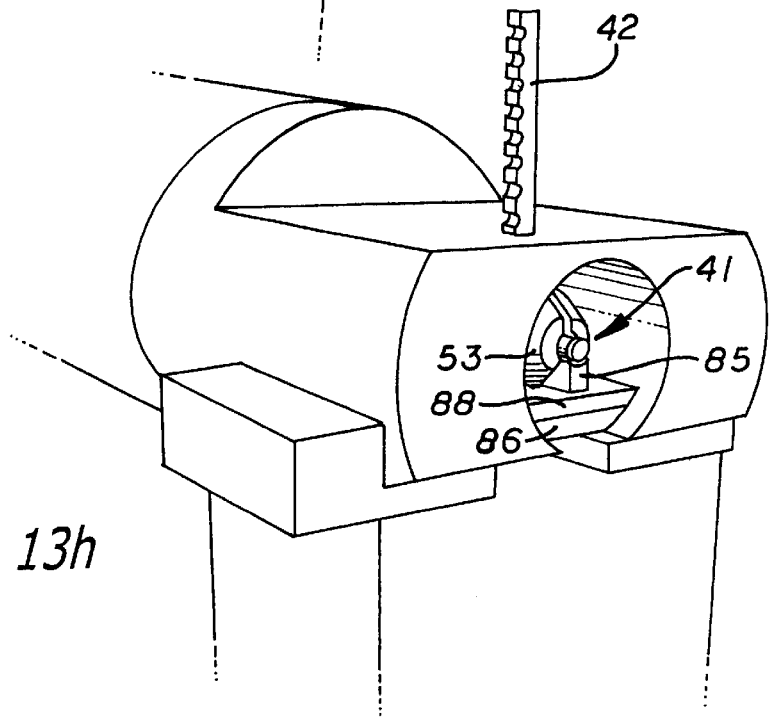
FIGS. 13*a* through 13*h* illustrate the next rivet loading sequence of the preferred embodiment of the present invention.
Figure 13D:
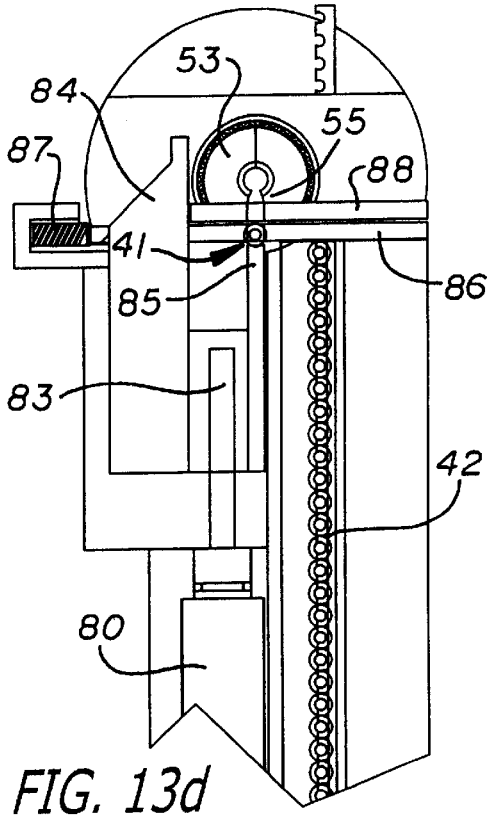
Figure 13E:
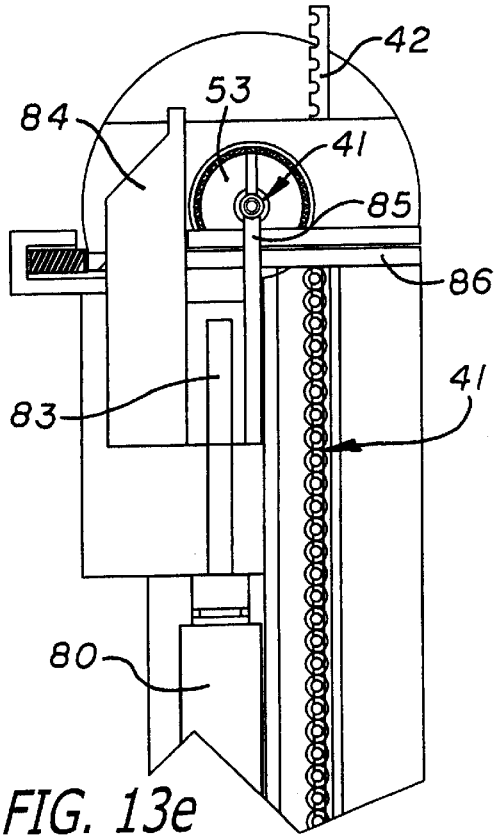
Figure 13G:
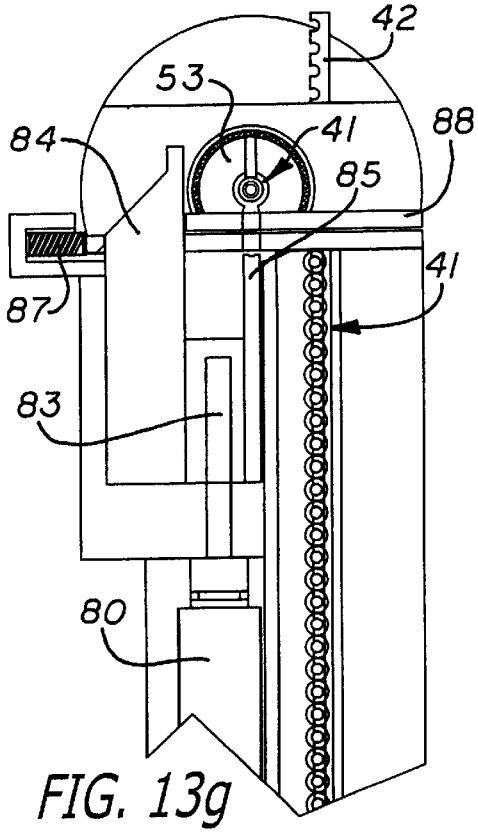

Referring again to FIG. 12*a,* it will be noted that upon depression of the trigger control 44, high pressure air is also ported to the bottom of actuator 80, forcing the cam plate 84 and the pressure plate 85 upward (see FIG. 9). As shown in FIG. 13*d,* slide plate 86 with the rivet captured by the opening therein (see FIG. 11) is forced to the left of the upward motion of the cam plate 84, stripping the rivet from the carrier 42 and moving the same to a position directly under members 53. Continued upward motion of the cam plate 84 and the pusher plate 85 causes the pusher plate to force the rivet upward through the opening in plate 88 and through the tapered region 55 of members 53 (FIG. 6), to be retained by members 53 as. shown in FIG. 13*e,* a view looking upward, and as shown in FIG. 13*c,* the side view of FIG. 13*f* and perspective of FIG. 13*h*. In that regard, FIGS. 13*b,* 13*c* and 13*f* also show the remaining stem from the previously pulled rivet.

When the trigger control 44 is released, regions 91 and 100 (FIG. 13*a*) are vented to atmosphere and the region between piston 69 and pressure barrier 61 is pressurized. Pressure remains, however, between piston 69 and piston 68 so that piston 69 will remain against the ends of pin 70 as the entire assembly moves to the left, the region between pistons 68 and 69 finally being vented through port 101 (FIG. 7*a*) in the final motion of the outer seal in piston 68 moving to the left of the port. At the same time, as may be seen in FIG. 7*a,* the top of actuator 80 is pressurized and the bottom vented to atmosphere, first withdrawing the pusher plate from fixed plate 88 and slide plate 87 as shown in FIG. 13*g,* and then further withdrawing the cam plate 84 to allow springs 87 to push the slide plate 86 to its right-most position (see FIG. 7*d*) to allow the next rivet on the carrier 42 to become engaged in the complementary opening of the slide plate in readiness for loading on the next operating cycle.

Figure 13A:
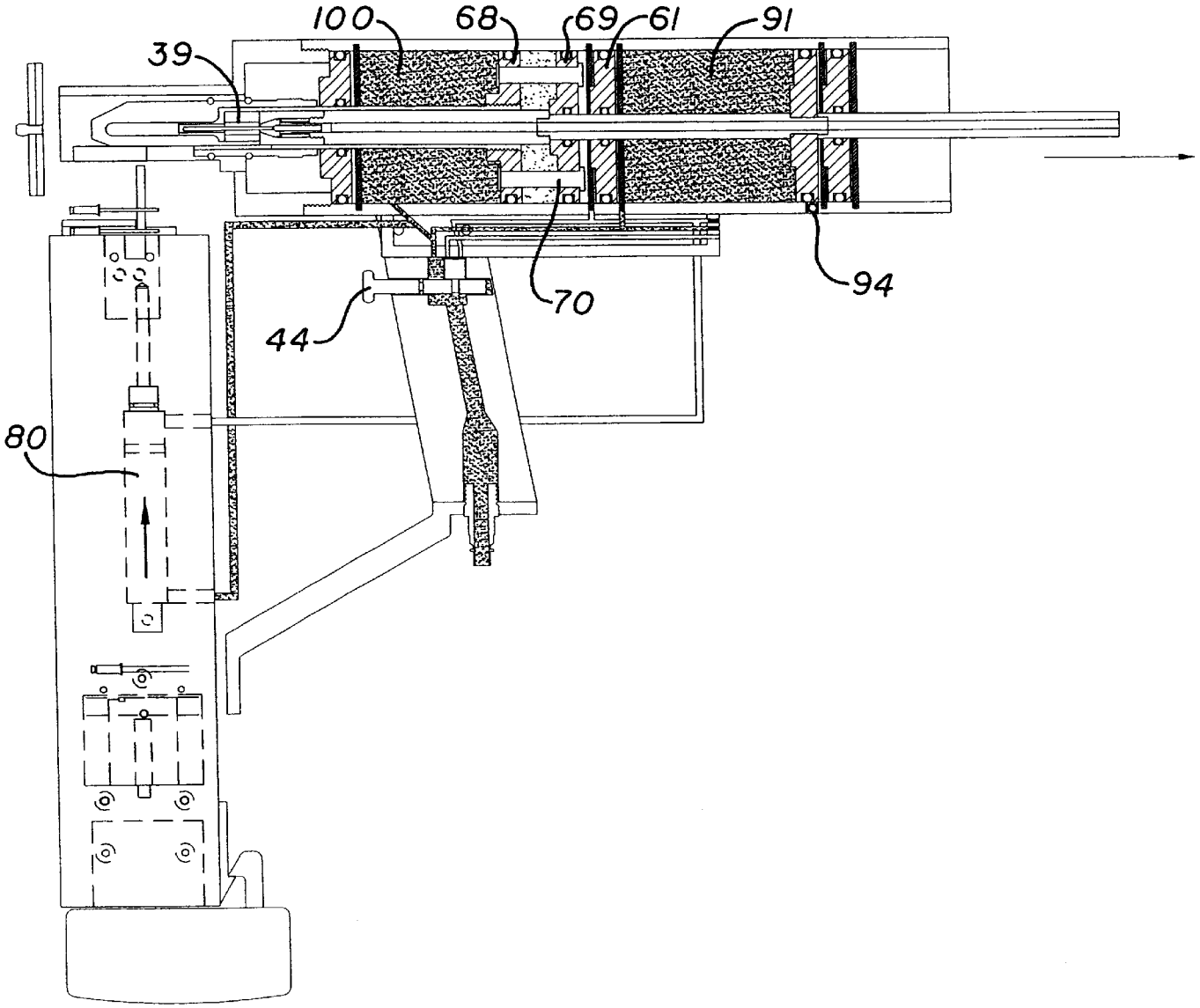
Figure 13B:
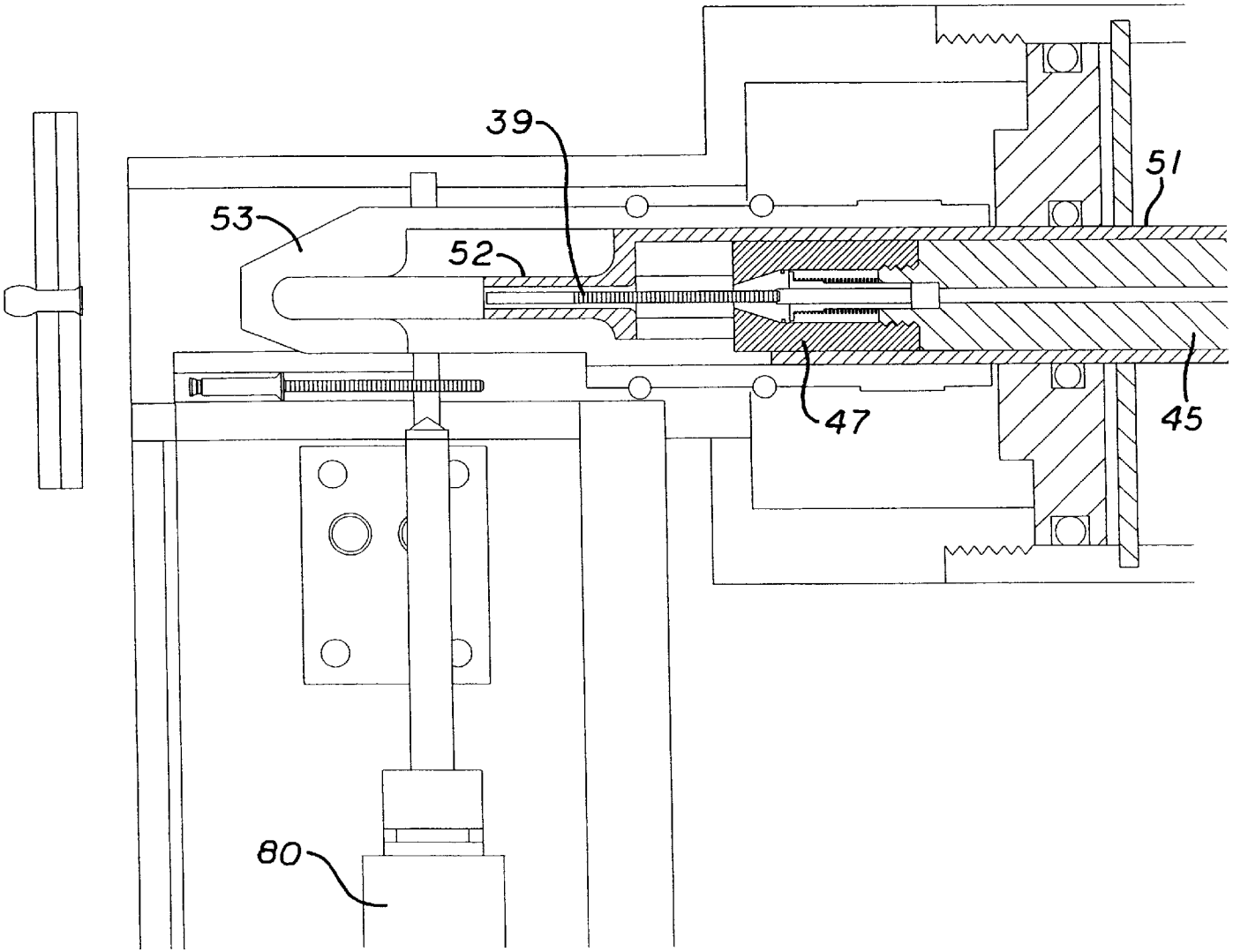
Figure 13C:
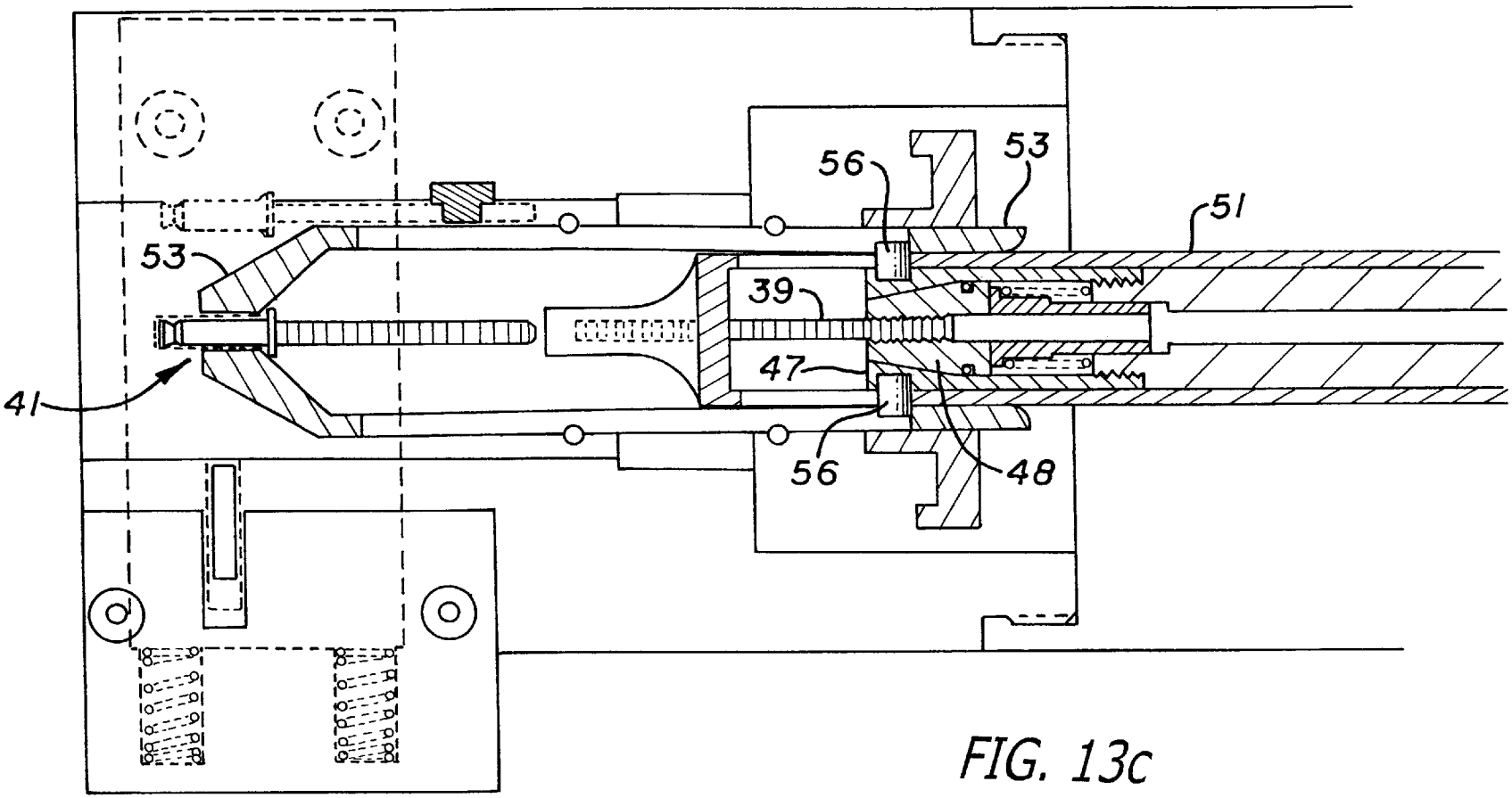
Figure 13F:
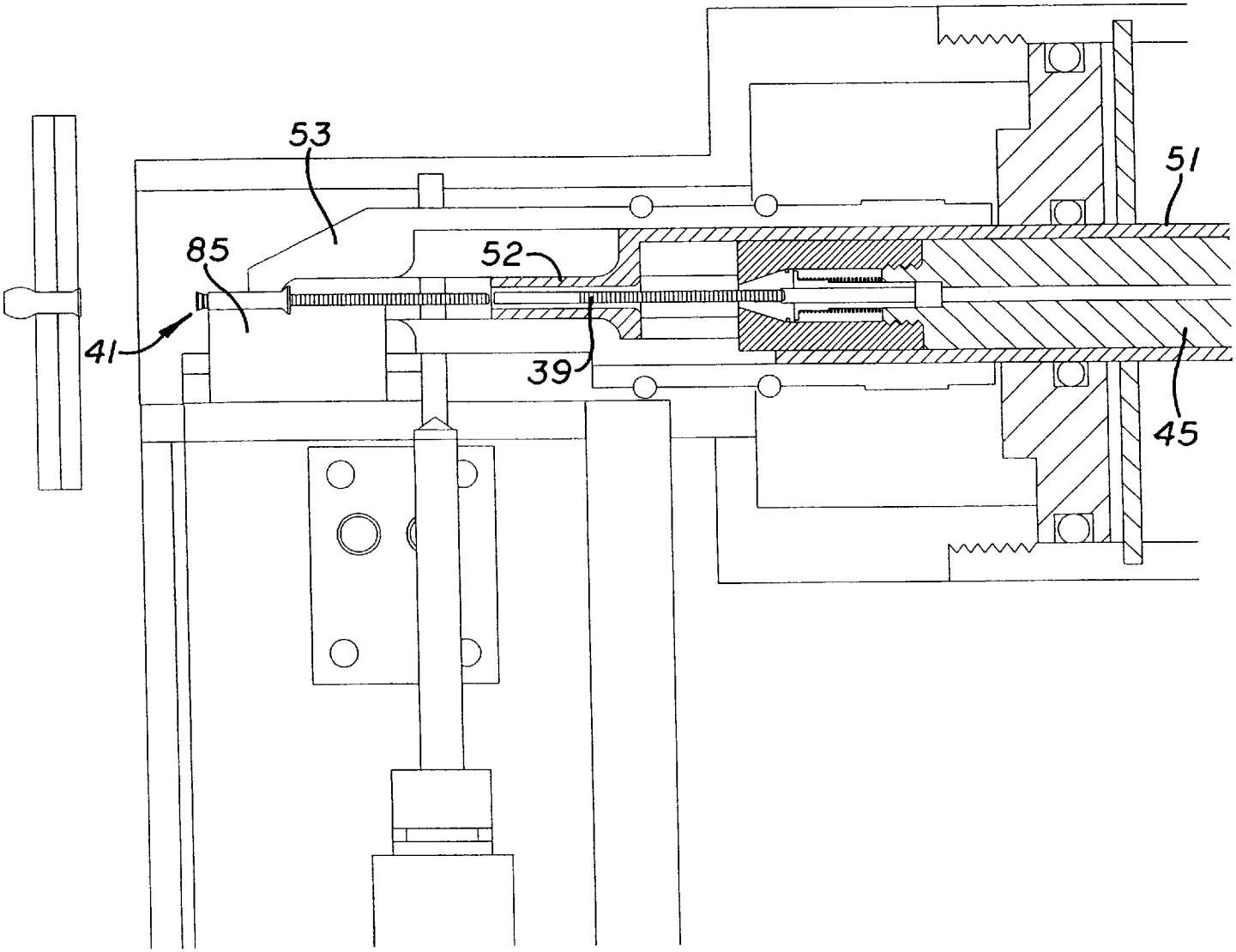

When the pulling actuator assembly is in the fully withdrawn position, as shown in FIGS. 13*a* and 13*b,* members 53 are also retracted (see FIG. 13*c*) by the engagement of pins 56 with the ends of the slots in members 53. As may be seen in FIG. 13*c,* a rivet 41 is retained by members 53 while the stem 39 of a previously pulled rivet remains in the jaws of the pulling head.

Referring again to FIG. 13*a,* when the trigger 44 is released, regions 99 and 100 are vented to the atmosphere and pressure is ported to the region between piston 69 and pressure barrier 61. Since high pressure air remains between pistons 68 and 69, pistons 68 and 69 will remain separated as shown in FIG. 13*a,* though will proceed to the left, passing through the position shown in FIG. 19. As may be seen therein, the stem 39 of the next rivet is passed through the opening in extension 52 of the housing, with the stem being grasped therein by pins 150 held in position by a spring wire ring 152. In that regard, as may also be seen in FIG. 18, pins 150 have an angled face 154 to allow a stem 39 to proceed into the housing 52, the angled pins 150 yieldably retracting against the spring force of spring wire member 152, though retaining the stem so as to not allow the forcing of the stem through the front of member 52. As pistons 68 and 69 continue to the left (FIG. 13*a*), the housing 52 pushes the rivet outward between members 53 to the pulling position, illustrated by way of example, in FIG. 7*c*. When reaching this position, the region between pistons 68 and 69 becomes vented to atmosphere through port 101 (see FIG. 7*a*), allowing piston 69 to continue forward to the position shown in FIG. 7*a,* pushing the drawbolt 45 forward so that the jaws of the pulling head engage the stem of the rivet as illustrated in FIG. 7*c,* preparing the gun and rivet for the next pulling cycle.

Figure 7E:
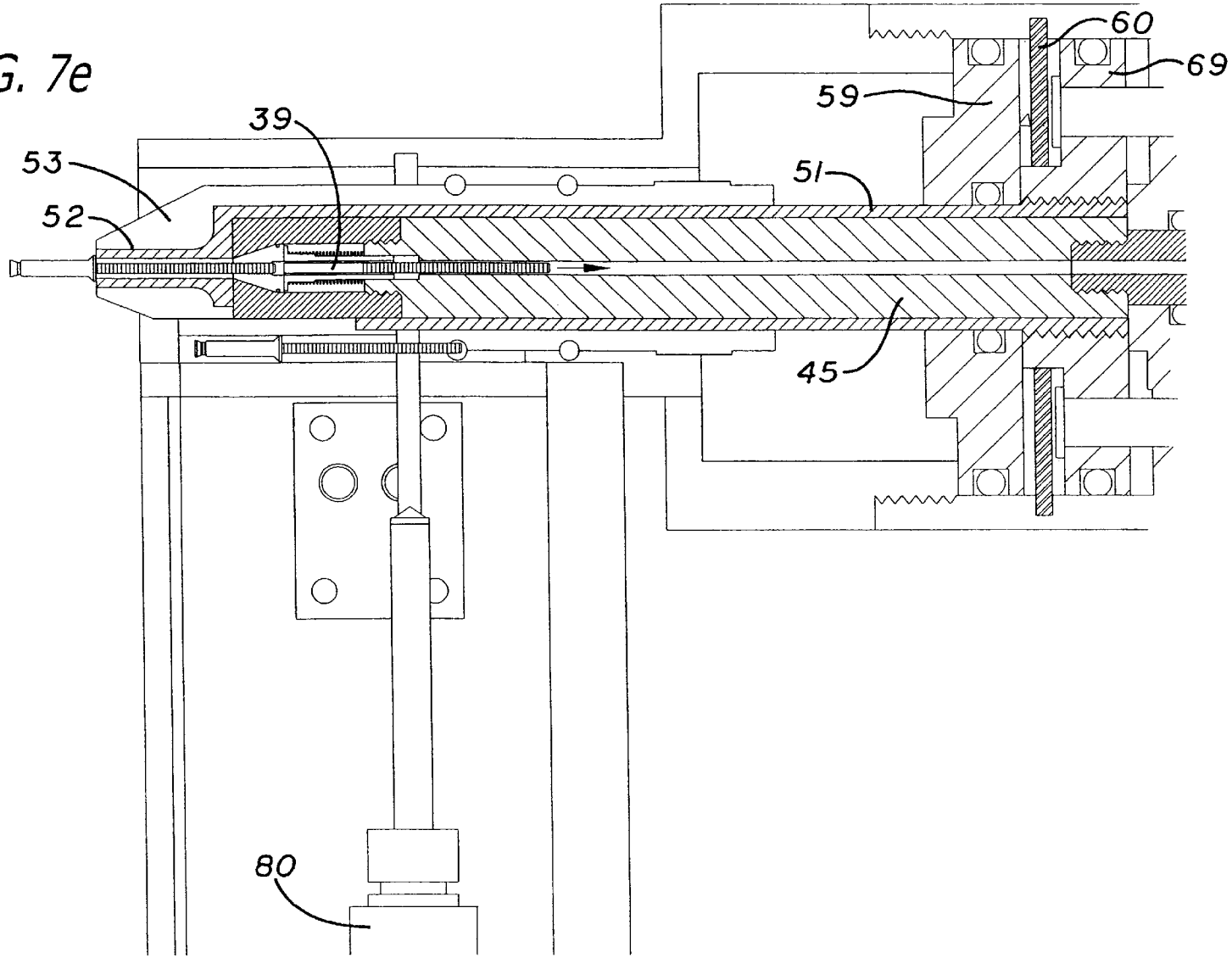
Figure 14:
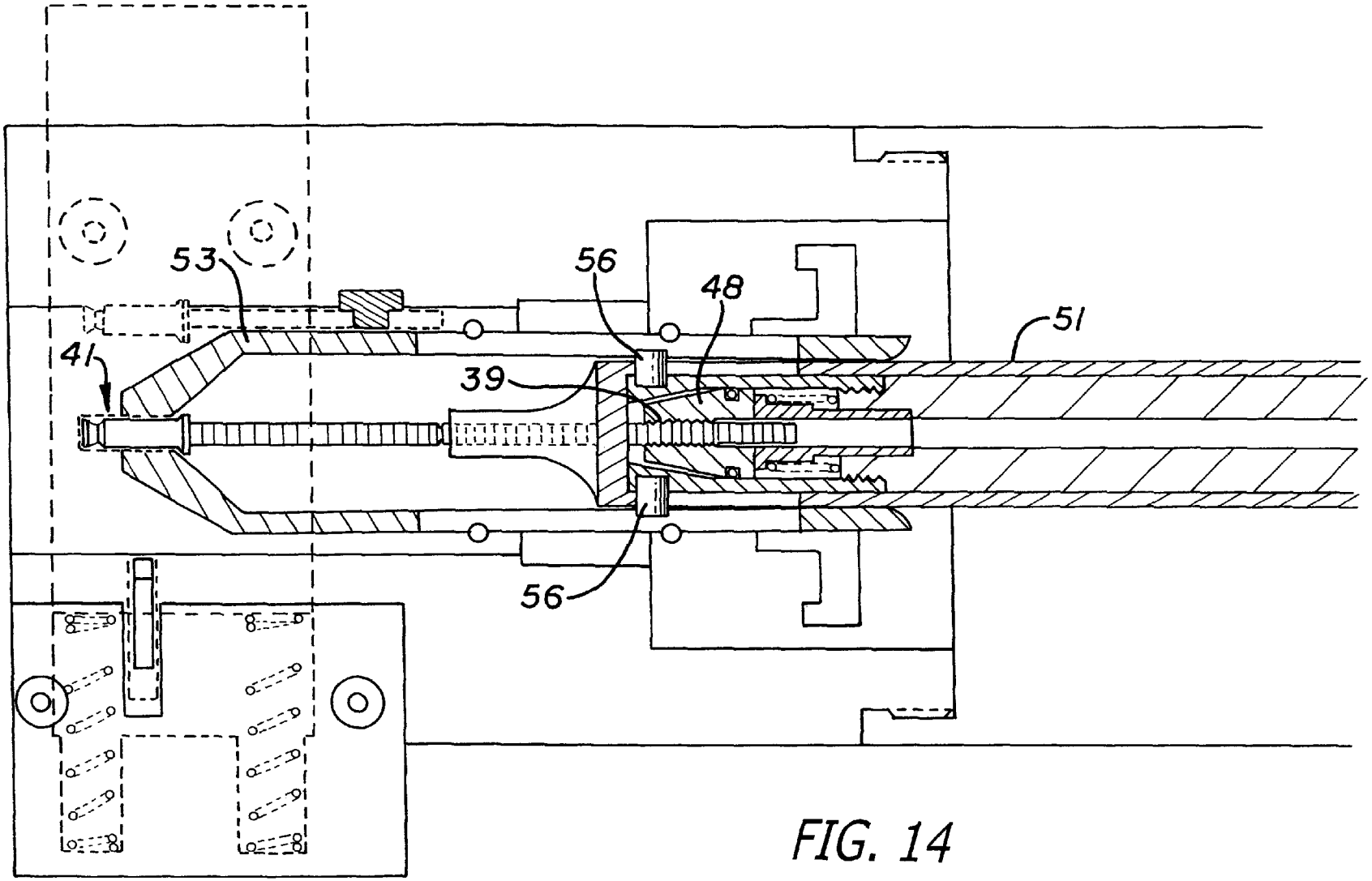
FIGS. 14 through 16 illustrate the ejection sequence of the preferred embodiment of the present invention for ejecting the stem of the previously pulled rivet from the pulling head.
Figure 15:
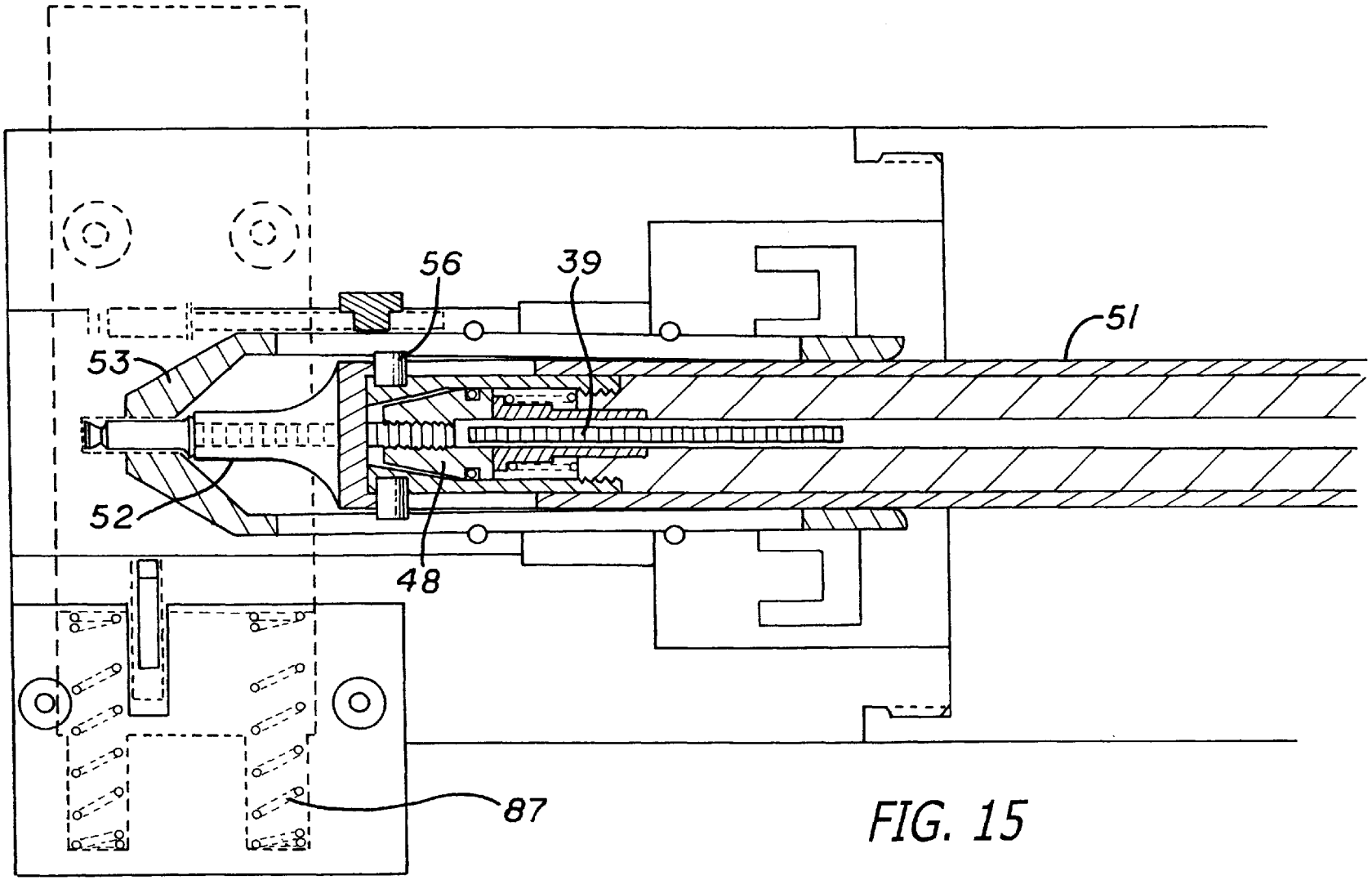
Figure 16:
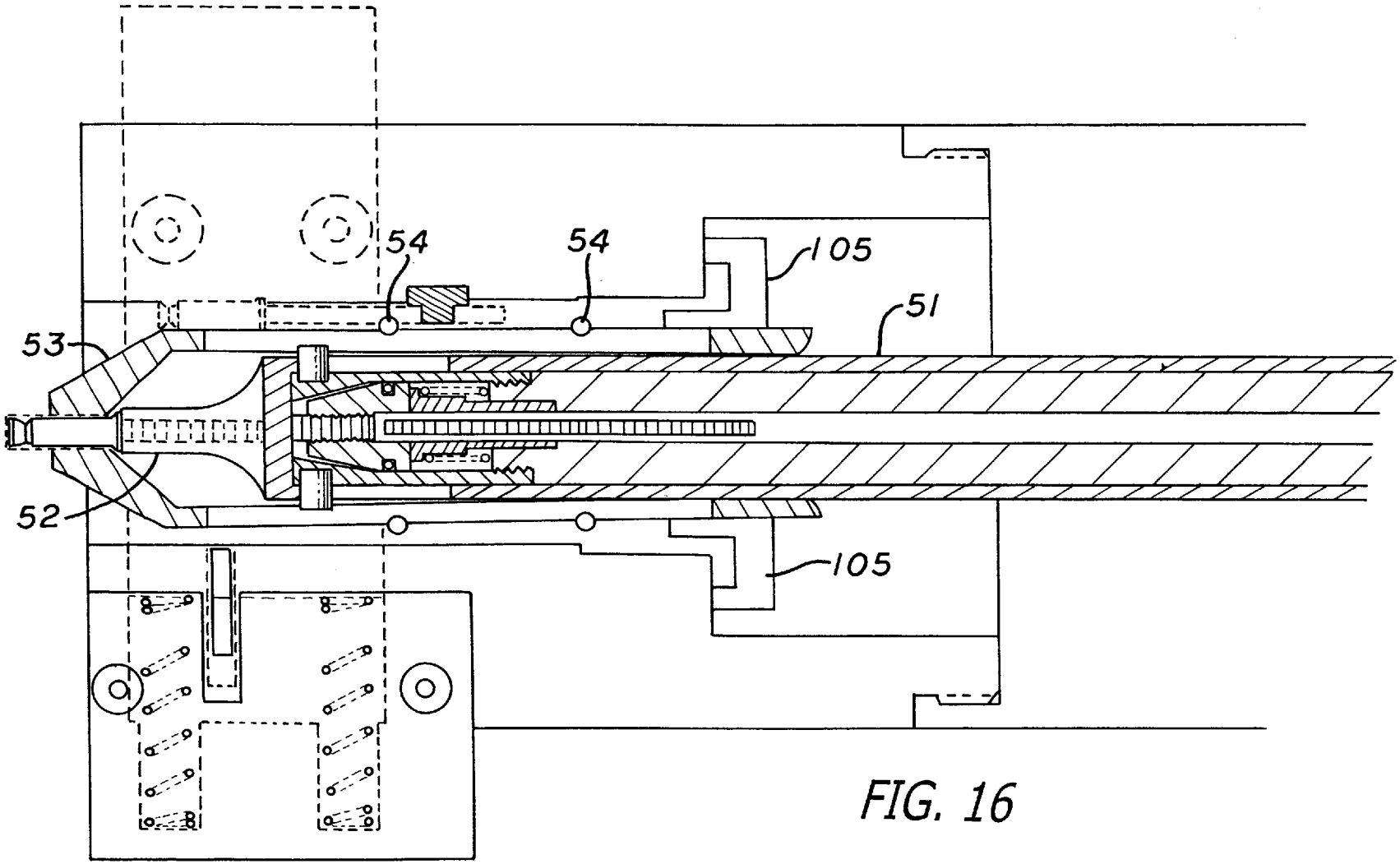
Figure 17:
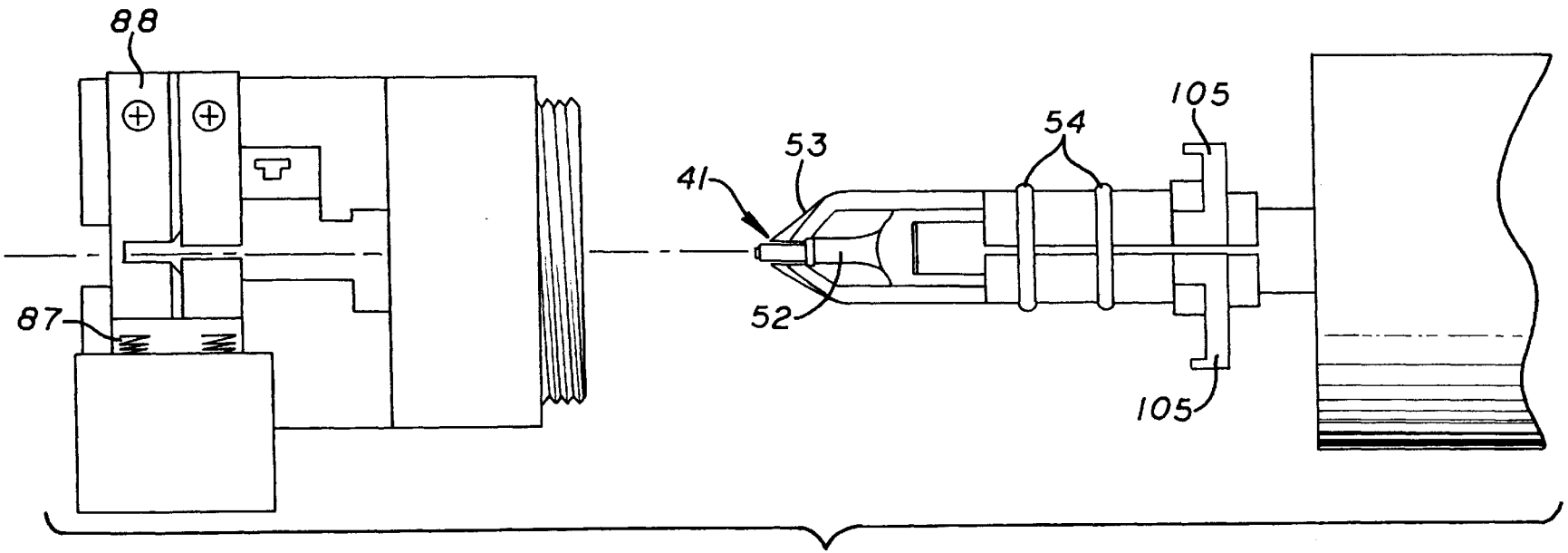
FIG. 17 is an exploded view of the pulling head and rivet holding members of the preferred embodiment.

In another embodiment, when the trigger 44 is released the region between pistons 68 and 69 (see FIG. 13*a*) may be vented, together with regions 91 and 100, in which case the pressure applied between piston 69 and pressure barrier 61 will first cause piston 69 to move to the left against piston 68 to extend the drawbolt relative to the housing, and then return pistons 68 and 69 in unison to the position shown in FIG. 7*c*. In this case, as the pulling actuator assembly moves to the left from the position shown in FIG. 13*a* to the position shown in FIG. 7*a* as previously described, housing 51, collet 47, jaws 48, etc. move to the left, as shown in FIG. 14, with the stem of the rivet just loaded hitting the end of the stem still retained in jaws 48, encouraging the jaws to the open position to push the stem of the already pulled rivet out of the jaws and causing the jaws to engage the stem of the rivet just loaded, as shown in FIG. 15. As the pulling head moves further to the left, members 53 will follow, though reaching the limit of their travel as shown in FIG. 16, after which the extension 52 in the housing 51 and/or the head of the rivet force members 53 to separate, allowing the rivet, housing and housing extension to extend to the pulling position, as illustrated in FIG. 7*a* through 7*d*. In that regard, the travel of members 53 is limited by members 105 coupled thereto, the members separating to allow the extension of a rivet therebetween against the elasticity of the O-rings 54, as shown in FIG. 17. The stems of the already pulled rivets are ejected from the pulling head (see FIG. 7*e*) and out the back of the draw bolt/draw bolt extensions into a collection reservoir (not shown) screwed onto the end of the barrel assembly 30 for stem collection purposes and as an operator protection from the motion of the draw bolt extension 67.

Figure 19:
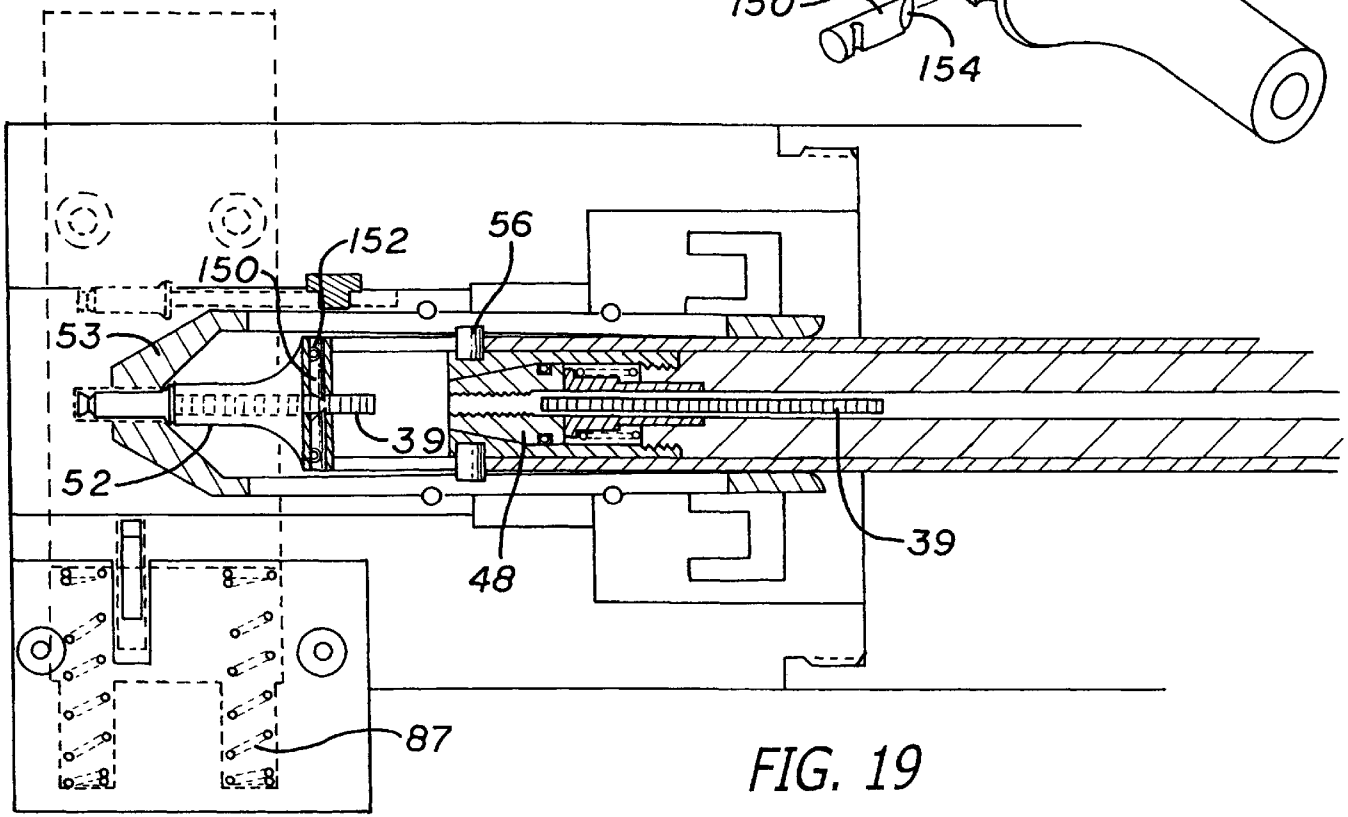
FIGS. 19 and 20 illustrate the relative positions of the mechanisms of an embodiment rivet gun with a rivet proceeding to the pulling position.
Figure 20:
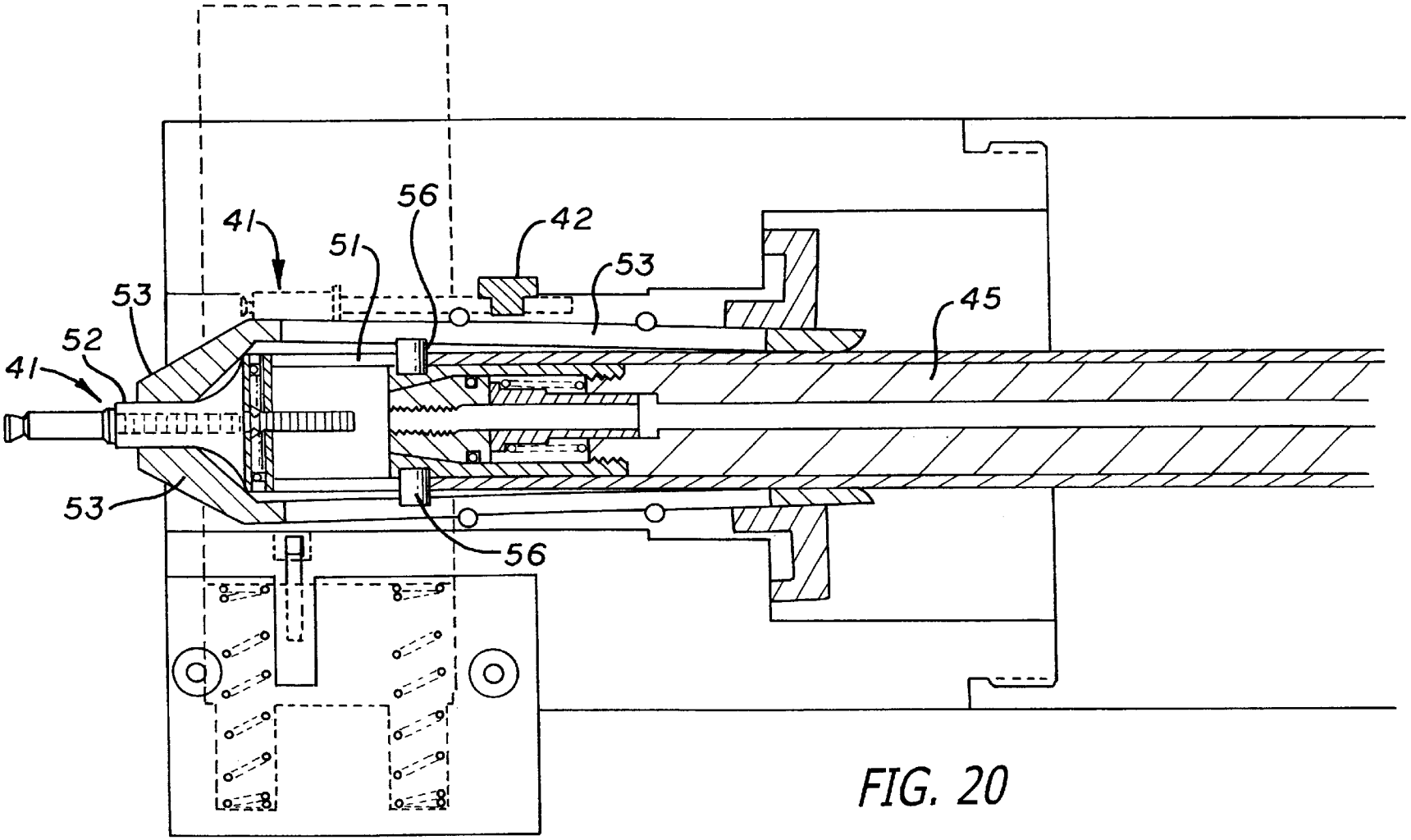
Figure 21:
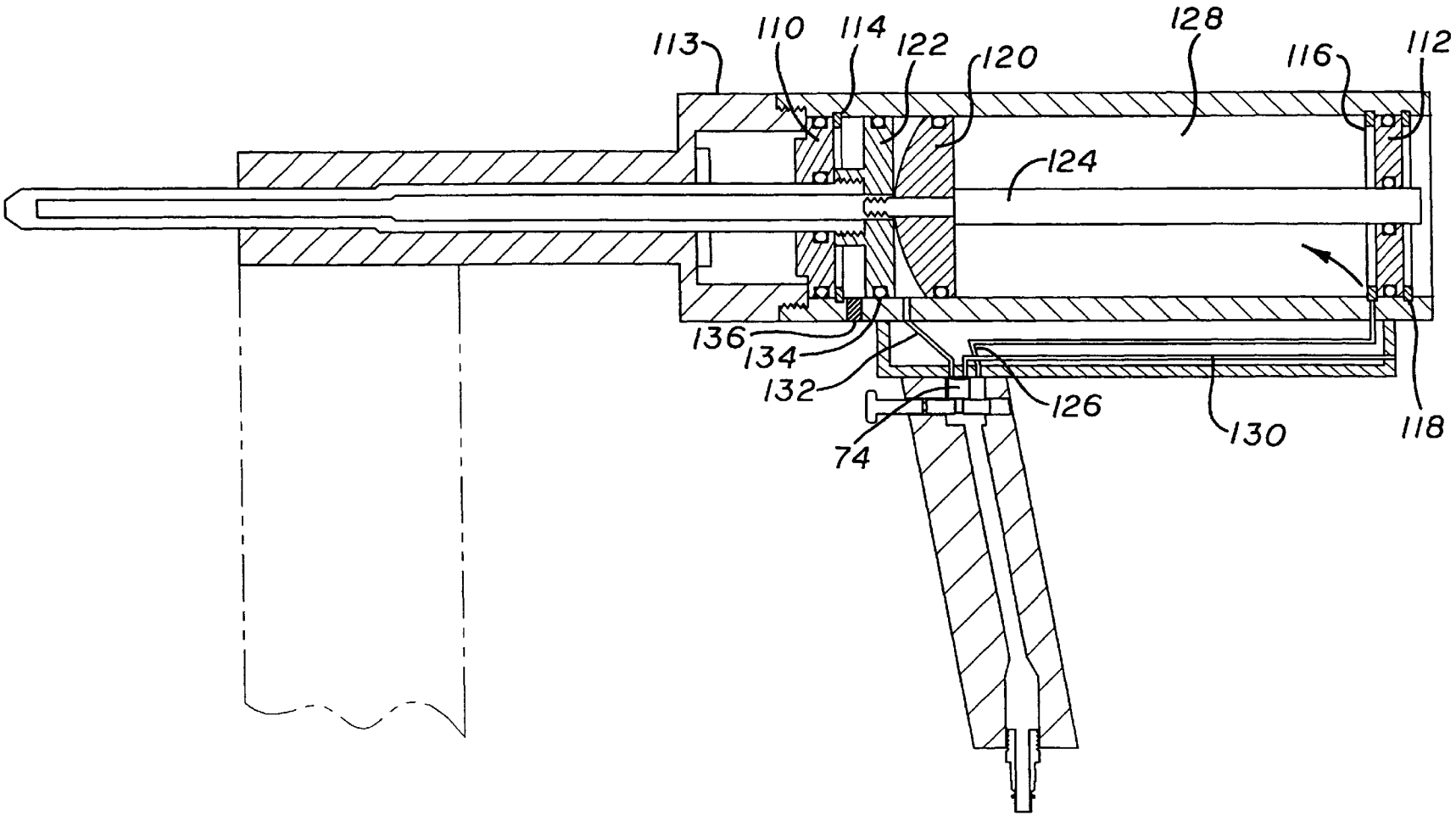
FIG. 21 is an illustration of portions of an alternate embodiment, primarily the barrel assembly of an alternate embodiment.

Now referring to FIG. 21, portions of an alternate embodiment, primarily the barrel assembly of an alternate embodiment, may be seen. While details of the pulling head, etc. are not shown in FIG. 21, they may be substantially the same as that shown for the previously described embodiment of FIGS. 18, 19 and 20. As may be seen in FIG. 21, a single chamber is defined by end plates 110 and 112. End plate 110 is held in position by forward barrel member 113 and snap ring 114, while end plate 112 is held in position by snap rings 116 and 118. Within the chamber are two pistons 120 and 122, piston 120 being connected to drawbolt extension 124 and piston 122 being connected to the housing, not shown in detail in FIG. 21, but corresponding to housing 51 of the previously described embodiment of FIGS. 18, 19 and 20.

Figure 18:
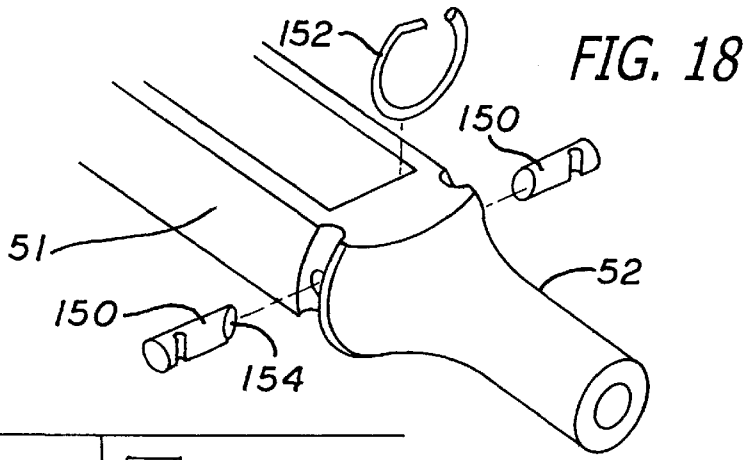
FIG. 18 is an exploded perspective view of a housing with rivet stem retention capability.

With trigger member 74 in the position shown, the region between pistons 120 and 122 is vented to atmosphere, while pressure is ducted through line 126 to region 128, pushing pistons 120 and 122 to their left-most position, as shown in FIG. 18. (The structure and operation of the trigger, as well as member 74, may be the same as in the previously described embodiments, such as by way of example, is shown in detail in FIG. 7*a*.) When the trigger 44 (see FIG. 7*a*) is depressed, member 74 of FIG. 18 will move to the right-hand position, coupling line 126 to the vent line 130 and applying high pressure air through line 132 to the region between pistons 120 and 122. This will cause piston 120, coupled to the drawbolt, to move toward the right as viewed in FIG. 18, while holding piston 122 to its left-most position, the housing coupled to piston 122 holding the blind rivet in the workpiece as the drawbolt draws the stem of the rivet to set the rivet. Setting the rivet results either in the stem of the rivet being pulled all of the way through the rivet, as by way of example in a tacking rivet, or lock part of the stem in the pulled rivet, after which the remaining portion of the stem breaks off. In either event, once the stem or broken portion of the stem is free of the set rivet, the drawbolt will reach its right-hand travel limit with respect to the housing. (See the pins 56, for instance, in FIG. 7*c* and the prior description of the operation thereof.) Thereafter, the momentum in piston 120 and the drawbolt assembly attached thereto will cause piston 122 and the housing attached thereto to move to the right in unison. This causes the peripheral seal 134 on piston 122 to move to the right of pressure port 132, now also pressurizing the region between piston 122 and end wall 110. This causes both pistons 120 and 122 to move to their right-most positions, also withdrawing members equivalent to members 53 of the prior embodiments to their right-hand most positions in readiness for loading of the next rivet as described with respect to the previous embodiment. At this point, the next rivet is put in position for capture by the pulling head as described with respect to the embodiment of FIGS. 18 through 20.

When the trigger is released, member 74 will return to the position shown in FIG. 21, pressurizing the region between piston 120 and end wall 112 and venting, at least initially, the region between piston 122 and end wall 110. Because high pressure air is trapped between pistons 120 and 122, the two pistons will maintain their maximum separation and will travel in unison toward the left, as shown in FIG. 21, until the peripheral seal 134 of piston 122 passes to the left of the now vented port 132. Now the region between pistons 120 and 122 will be vented, allowing the pressure on the right side of piston 69 to force piston 69 against piston 68, extending the drawbolt 124 to grasp the stem of the rivet in the pulling jaws in readiness for the next pulling cycle (see FIG. 7*c* for reference). When the peripheral seal 134 of piston 122 passes to the left of the vented port 132, a small amount of air will be trapped in front of the piston. The pressure rise because of this trapped air may be held to a minimum, and/or a restricted vent to atmosphere such as a small hole in the cylinder wall or a hole filled with a restrictive filter material may be used to vent this area, as in vent 136. The restriction preferably will not significantly interfere with the ability to pressurize this area during the rivet gun's operating cycle.

The advantage of the foregoing embodiment is that it facilitates a longer stroke, allowing the use of the rivet gun in closer proximity to adjacent structures in the parts being joined. In this embodiment, as in the other embodiments disclosed, the rivet stems or broken off stem parts may be collected in a receptacle at the rear of the rivet gun.

Thus, it may be seen that in the present invention a magazine assembly is provided for holding a plurality of rivets, with each successive rivet being loaded into the pulling position upon pulling of the preceding rivet, thereby providing an automatic rivet gun requiring only an appropriate source of power and the control of an operator for the rapid installation of blind rivets, whether by use of temporary or tacking rivets, or permanent rivets, either of the type wherein a stem is pulled entirely through the shank and head of the rivet or of other types, such as wherein, on pulling, a part of the stem is locked to the rest of the rivet while the remainder of the stem is fractured therefrom and disposed of. In the embodiment disclosed herein, pneumatic actuation is used, though other well known forms of actuators may also be used, including but not limited to, electromagnetic actuators. Similarly, different magazine assemblies and actuators may be used, whether or not the rivets are disposed on a carrier of similar or different design as in the preferred embodiment disclosed herein. Thus, it will be understood that a preferred embodiment has been disclosed herein only for purposes of specificity in the description given herein and not by way of limitation. It will be obvious skilled in the art that various changes in form and detail may be made in the invention without departing from the spirit and scope thereof.

What is claimed is:

1. A rivet gun with automatic feeding rivets comprising:

a plurality of blind rivets each having a shank with first and second ends and an integral head on the first end of the shank, and a stem extending through the head and shank for pulling relative to the head to form the second end of the rivet and set the rivet, the blind rivets being fixed to a carrier; and, a rivet gun having:

pulling head for pulling a rivet stem relative to the rivet head along an axis of the rivet and pulling head, the pulling head having a housing for resting adjacent the rivet head and a jaw assembly for gripping and pulling the rivet stem relative to the housing;

means for withdrawing the pulling head after pulling each rivet; and, a rivet loading means receiving the carrier with rivets thereon, removing successive rivets from the carrier at a position wherein the rivet and pulling head are not coaxial, moving each successive rivet to a position coaxial with the pulling head, and loading successive rivets into the pulling head after a previous rivet is pulled.

2. The rivet gun of claim 1 further comprised of a manually operable control controlling the pulling head and the rivet loading mechanism.

3. The rivet gun of claim 2 wherein the manually operable control is a single manually operable control.

4. The rivet gun of claim 2 further comprised of a first actuator means controlling the pulling head and a second actuator means controlling the rivet loading mechanism, the manually operable control controlling the pulling head and the rivet loading mechanism through control of the first and second actuator means.

5. The rivet gun of claim 4 wherein the first and second actuator means are pneumatic actuators.

6. The rivet gun of claim 5 wherein the manually operable control directly controls the first actuator means, the second actuator means being controlled by the motion of the first actuator means.

7. The rivet gun of claim 6 wherein the first actuator means is adapted to withdraw the pulling head after pulling a rivet stem, and the rivet loading means is adapted to successively remove rivets from the carrier and load successive rivets into the pulling head by positioning each successive rivet coaxial with the pulling head for receipt of the rivet as the pulling head returns from the withdrawn position, the carrier being positioned to the side of the axis of the pulling head to allow the free passage of the pulling head thereby when the pulling head returns from the withdrawn position.

8. The rivet gun of claim 4 wherein the first actuator means, when initiated by operation of the manually operable control, causes the pulling head to pull the rivet stem relative to the rivet head and then withdraw the pulling head.

9. The rivet gun of claim 8 wherein the second actuator means is responsive to the operation of the manually operable control to cause the next rivet to be removed from the carrier and disposed in front of the pulling head.

10. The rivet gun of claim 1 wherein the blind rivets are fixed to the carrier by their stems, the rivet loading means loading successive rivets into the pulling head by engaging successive rivets on the carrier for removal from the carrier and translation perpendicular to the axis of the rivet to a position coaxial with the pulling head.

11. The rivet gun of claim 10 wherein the blind rivets are tack rivets having a conical head, and wherein the rivet loading mechanism loads successive rivets into the pulling head by engaging each rivet on the carrier by its shank and head by a member having a shape complimentary to the shape of the rivet shank and head for removal of the rivet from the carrier.

12. The rivet gun of claim 1 wherein the carrier is an elongate carrier and the rivet stems are held in grooves in the carrier to dispose the rivets in parallel disposition perpendicular to the length of the carrier.

13. The rivet gun of claim 1 wherein the rivet loading mechanism removes successive rivets from the carrier at a position wherein the rivet and pulling head are not coaxial and moves each successive rivet to a position coaxial with the pulling head by first moving each successive rivet in a first direction and then moving the rivet in a second direction different from the first direction.

14. The rivet gun of claim 13 wherein the first and second directions are orthogonal directions.

15. The rivet gun of claim 14 wherein the first and second directions are orthogonal directions also orthogonal to the axis of the pulling head.

16. A method of installing blind rivets, each having a shank with first and second ends and an integral head on the first end of the shank, and a stem extending through the head and shank for pulling relative to the head to form the second end of the rivet and set the rivet, comprising:

fixing a plurality of the blind rivets to a carrier in close side by side proximity;

installing the carrier with the rivets thereon into a manually operable rivet gun having a pulling head for receiving the stem of a rivet and operable to pull the rivet stem relative to the head of the rivet to set the rivet, and by control of a manual control on the rivet gun:

operating the pulling head when in a pulling position to pull the stem of a rivet engaged by the pulling head to set a rivet;

withdrawing the pulling head to a retracted position;

removing the next rivet from the carrier at a position wherein the rivet and the pulling head are not coaxial;

translating the rivet to a position in front of and coaxial with the pulling head; and, returning the pulling head to the pulling position, the pulling head passing to the side of the carrier and engaging the rivet disposed in front of the pulling head as the pulling head returns to the pulling position.

17. The method of claim 16 wherein the pulling head engages a rivet by jaws engaging the rivet stem.

18. The method of claim 17 wherein the stem of a previously set rivet is pushed through the jaws by the stem of the next rivet as it is engaged by the pulling head.

19. The method of claim 16 wherein the manual control controls a source of air under pressure.

20. The method of claim 16 wherein the rivets are conical head tacking rivets, and the stem of each rivet is pulled through the shank and head of the rivet to set the rivet.

21. The method of claim 20 further comprising collecting the stems of pulled rivets adjacent an end of the rivet gun opposite the pulling head.

22. The method of claim 16 wherein the rivets include a lock and the rivet stems include a predetermined fracture point, and wherein the stem of each rivet is pulled to set the rivet, after which the rivet stem fractures.

23. The method of claim 22 further comprising collecting the fractured stems of pulled rivets adjacent an end of the rivet gun opposite the pulling head.

24. The method of claim 16 wherein the rivet loading mechanism removes successive rivets from the carrier at a position wherein the rivet and pulling head are not coaxial and moves each successive rivet to a position coaxial with the pulling head by first moving each successive rivet in a first direction and then moving the rivet in a second direction different from the first direction.

25. The method of claim 24 wherein the first and second directions are orthogonal directions.

26. The method of claim 25 wherein the first and second directions are orthogonal directions also orthogonal to the axis of the pulling head.

27. A rivet gun comprising:

a rivet gun adapted to receive a plurality of blind rivets, each having a shank with first and second ends and an integral head on the first end of the shank, and a stem extending through the head and shank for pulling relative to the head to form the second end of the rivet and set the rivet, the blind rivets being fixed to a carrier;

the rivet gun having:

a pulling head for pulling a rivet stem relative to the rivet head along an axis of the rivet and pulling head, the pulling head having a housing for resting adjacent the rivet head and a jaw assembly for gripping and pulling the rivet stem relative to the housing;

means for withdrawing the pulling head after pulling each rivet; and, a rivet loading means adapted to receive the carrier with rivets thereon, remove successive rivets from the carrier at a position wherein the rivet and pulling head are not coaxial, translate each successive rivet to a position coaxial with the pulling head, and load successive rivets into the pulling head after a previous rivet is pulled.

28. The rivet gun of claim 27 further comprised of a manually operable control controlling the pulling head and the rivet loading means.

29. The rivet gun of claim 28 further comprised of a first actuator controlling the pulling head and a second actuator controlling the rivet loading means, the manually operable control controlling the pulling head and the rivet loading means through control of the first and second actuators.

30. The rivet gun of claim 29 wherein the first and second actuators are pneumatic actuators.

31. The rivet gun of claim 30 wherein the manually operable control directly controls the first actuator, the second actuator being controlled by the motion of the first actuator.

32. The rivet gun of claim 31 wherein the first actuator is a means adapted to withdraw the pulling head after pulling a rivet stem, and the rivet loading means is adapted to successively remove rivets from the carrier and load successive rivets into the pulling head by positioning each successive rivet coaxial with the pulling head for receipt of the rivet as the pulling head returns from the withdrawn position, the carrier being positioned to the side of the axis of the pulling head to allow the free passage of the pulling head thereby when the pulling head returns from the withdrawn position.

33. The rivet gun of claim 32 wherein the blind rivets are fixed to the carrier by their stems, the rivet loading means loading successive rivets into the pulling head by engaging successive rivets on the carrier for removal from the carrier and translation perpendicular to the axis of the rivet to a position coaxial with the pulling head.

34. The rivet gun of claim 31 wherein the first actuator is a means that, when initiated by operation of the manually operable control, causes the pulling head to pull the rivet stem relative to the rivet head and then withdraw the pulling head.

35. The rivet gun of claim 34 wherein the second actuator is a means responsive to the operation of the first actuator means to cause the next rivet to be removed from the carrier and disposed in front of the pulling head.

36. The rivet gun of claim 28 wherein the manually operable control is a single manually operable control.

37. The rivet gun of claim 27 wherein the blind rivets are tack rivets having a conical head, and wherein the rivet loading means loads successive rivets into the pulling head by engaging each rivet on the carrier by its shank and head by a member having a shape complimentary to the shape of the rivet shank and head for removal of the rivet from the carrier.

38. The rivet gun of claim 27 wherein the rivet gun is adapted to receive an elongate carrier with rivet stems held in grooves in the carrier to dispose the rivets in parallel disposition perpendicular to the length of the carrier.

39. A rivet gun with automatic feeding rivets comprising:

a plurality of blind rivets each having a shank with first and second ends and an integral head on the first end of the shank, and a stem extending through the head and shank for pulling relative to the head to form the second end of the rivet and set the rivet, the blind rivets being fixed to a carrier; and, a rivet gun having:

a pulling head for pulling a rivet stem relative to the rivet head along an axis of the rivet and pulling head, the pulling head having a housing for resting adjacent the rivet head and a jaw assembly for gripping and pulling the rivet stem relative to the housing;

a rivet loading means receiving the carrier with rivets thereon, removing successive rivets from the carrier at a position wherein the rivet and pulling head are not coaxial, moving each successive rivet to a position coaxial with the pulling head, and loading successive rivets into the pulling head after a previous rivet is pulled;

a manually operable control controlling the pulling head and the rivet loading means;

a first actuator controlling the pulling head and a second actuator controlling the rivet loading means, the manually operable control directly controlling the first actuator, the second actuator being controlled by the motion of the first actuator; and, the first actuator being a means adapted to withdraw the pulling head after pulling a rivet stem;

the rivet loading means being adapted to successively remove rivets from the carrier and load successive rivets into the pulling head by positioning each successive rivet coaxial with the pulling head for receipt of the rivet as the pulling head returns from the withdrawn position, the carrier being positioned to the side of the axis of the pulling head to allow the free passage of the pulling head thereby when the pulling head returns from the withdrawn position.

40. A rivet gun with automatic feeding rivets comprising:

a plurality of blind rivets each having a shank with first and second ends and an integral head on the first end of the shank, and a stem extending through the head and shank for pulling relative to the head to form the second end of the rivet and set the rivet, the blind rivets being fixed to a carrier; and, a rivet gun having:

a pulling head for pulling a rivet stem relative to the rivet head along an axis of the rivet and pulling head, the pulling head having a housing for resting adjacent the rivet head and a jaw assembly for gripping and pulling the rivet stem relative to the housing;

a rivet loading means receiving the carrier with rivets thereon, removing successive rivets from the carrier at a position wherein the rivet and pulling head are not coaxial, moving each successive rivet to a position coaxial with the pulling head, and loading successive rivets into the pulling head after a previous rivet is pulled;

a manually operable control controlling the pulling head and the rivet loading means;

a first actuator controlling the pulling head and a second actuator controlling the rivet loading means, the manually operable control controlling the pulling head and the rivet loading means through the control of the first and second actuators; and, the first actuator, when initiated by operation of the manually operable control, causing the pulling head to pull the rivet stem relative to the rivet head and then withdraw the pulling head.

41. The rivet gun of claim 40 wherein the second actuator is responsive to the operation of the manually operable control to cause the next rivet to be removed from the carrier and disposed in front of the pulling head.

42. The apparatus of claim 41 wherein the first actuator is a means that, when the manually operable control is released, causes the pulling head to return the pulling head to engage the rivet in front of the pulling head to the pulling position and engaging the rivet disposed in front of the pulling head by the second actuator.

43. A rivet gun with automatic feeding rivets comprising:

a plurality of blind rivets each having a shank with first and second ends and an integral head on the first end of the shank, and a stem extending through the head and shank for pulling relative to the head to form the second end of the rivet and set the rivet, the blind rivets being fixed to a carrier; and, a rivet gun having:

a pulling head for pulling a rivet stem relative to the rivet head along an axis of the rivet and pulling head, the pulling head having a housing for resting adjacent the rivet head and a jaw assembly for gripping and pulling the rivet stem relative to the housing; and, a rivet loading means receiving the carrier with rivets thereon, removing successive rivets from the carrier at a position wherein the rivet aid pulling head are not coaxial, moving each successive rivet to a position coaxial with the pulling head, and loading successive rivets into the pulling head after a previous rivet is pulled;

wherein the rivet loading means removes successive rivets from the carrier at a position wherein the rivet and pulling head are not coaxial and moves each successive rivet to a position coaxial with the pulling head by first moving each successive rivet in a first direction and then moving the rivet in a second direction different from the first direction, the first and second directions being orthogonal directions also orthogonal to the axis of the pulling head.

44. A method of installing blind rivets, each having a shank with first and second ends and an integral head on the first end of the shank, and a stem extending through the head and shank for pulling relative to the head to form the second end of the rivet and set the rivet, comprising:

fixing a plurality of the blind rivets to a carrier;

installing the carrier with the rivets thereon into a manually operable rivet gun having a pulling head for receiving the stem of a rivet and operable to pull the rivet stem relative to the head of the rivet to set the rivet, and by control of a manual control on the rivet gun:

operating the pulling head when in a pulling position to pull the stem of a rivet engaged by the pulling head to set a rivet;

withdrawing the pulling head to a retracted position;

removing the next rivet from the carrier and disposing the rivet in front of the pulling head; and, returning the pulling head to the pulling position, the pulling head engaging the rivet disposed of in front of the pulling head as the pulling head returns to the pulling position.

45. The method of claim 44 wherein the pulling head engages a rivet by jaws engaging the rivet stem.

46. The method of claim 45 wherein the stem of a previously set rivet is pushed through the jaws by the stem of the next rivet as it is engaged by the pulling stem.

47. The method of claim 44 wherein the manual control controls a source of air under pressure.

48. The method of claim 44 wherein the rivets are conical head tacking rivets, and the stem of each rivet is pulled through the shank and head of the rivet to set the rivet.

49. The method of claim 48 further comprising expelling the stems of pulled rivets through an end of the rivet gun opposite the pulling head.

50. The method of claim 44 wherein the rivets include a lock and the rivet stems include a predetermined fracture point, and wherein the stem of each rivet is pulled to set the rivet, after which the rivet stem fractures.

51. The method of claim 50 further comprising expelling the fractured stems of pulled rivets through an end of the rivet gun opposite the pulling head.

* * * * *